US005745975A

United States Patent [19]

Heisner et al.

[11] Patent Number: 5,745,975

[45] Date of Patent: May 5, 1998

[54] WIRE HARNESS TERMINATION APPARATUS FOR PROGRAMMABLE CONNECTORS

[75] Inventors: Douglas Lester Heisner, Downers Grove; Peter Ingwersen, Gilberts; Thomas P. Pellegrino, Lise; Eric Stenstrom, Warrenville; Kevin J. Urness, St. Charles; Steven Wright, Glen Ellyn, all of Ill.

[73] Assignee: Molex Incorporated, Lisle, Ill.

[21] Appl. No.: 700,895

[22] Filed: Aug. 21, 1996

[51] Int. Cl.[6] ..... H01R 43/00

[52] U.S. Cl. ..... 29/564.6; 29/33 M; 29/755

[58] Field of Search ..... 29/33 M, 759, 29/749, 755, 748, 753, 564.4, 564.6, 825, 564.1, 566.3, 566.1

[56] References Cited

U.S. PATENT DOCUMENTS

| | | | |
|---|---|---|---|
| 4,043,017 | 8/1977 | Folk et al. | 29/749 |
| 4,551,893 | 11/1985 | Ikeda et al. | 29/33 M |
| 4,563,810 | 1/1986 | Adlon et al. | 29/759 X |
| 5,110,255 | 5/1992 | LeBan et al. | 29/753 X |
| 5,138,762 | 8/1992 | LeBan et al. | 29/566.3 X |
| 5,365,659 | 11/1994 | Veda et al. | 29/755 X |
| 5,457,875 | 10/1995 | Ohta et al. | 29/33 M X |
| 5,471,741 | 12/1995 | Heisner et al. | 29/564.1 X |

FOREIGN PATENT DOCUMENTS

| | | | |
|---|---|---|---|
| 37 202 | 10/1981 | European Pat. Off. | 29/564.4 |
| 46076 | 2/1982 | European Pat. Off. | 29/564.4 |

*Primary Examiner*—William R. Briggs

[57] ABSTRACT

A machine for producing wire harnesses of the type having multiple connectors terminated to the wires of the harness, the connectors being arranged in serial order along the length of the wire harness and some of the connectors being of two-piece construction is disclosed. The machine includes a reciprocating carriage and a nest that retains a lead connector in place during termination and subsequent advancement of the harness wires. The carriage is received within a termination assembly which has different termination members for different connectors.

19 Claims, 20 Drawing Sheets

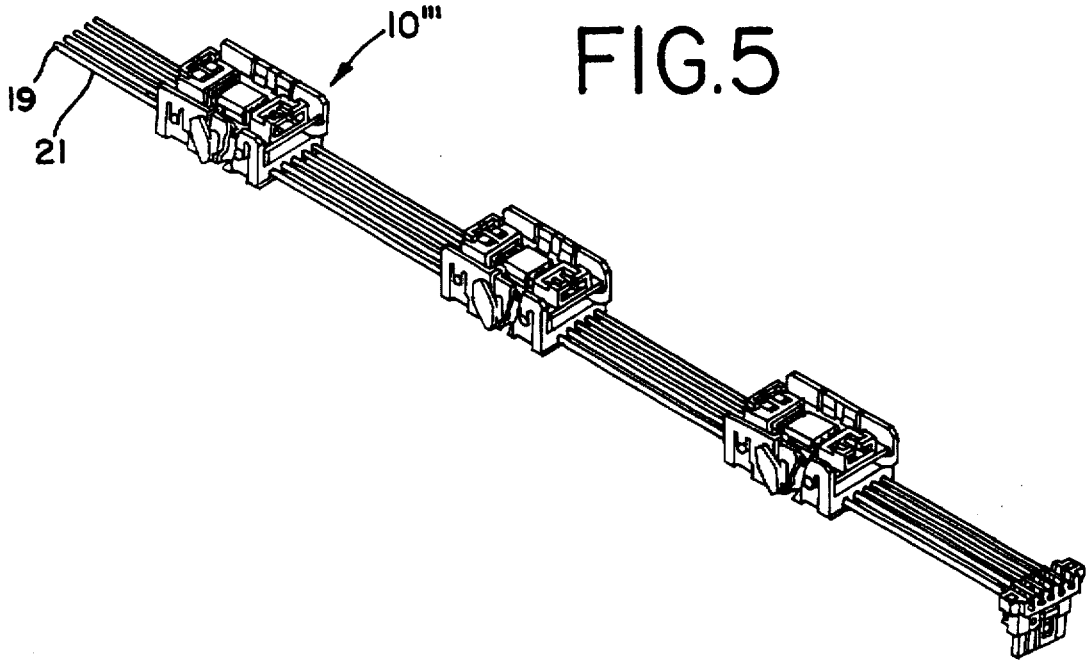
FIG.5
FIG.6
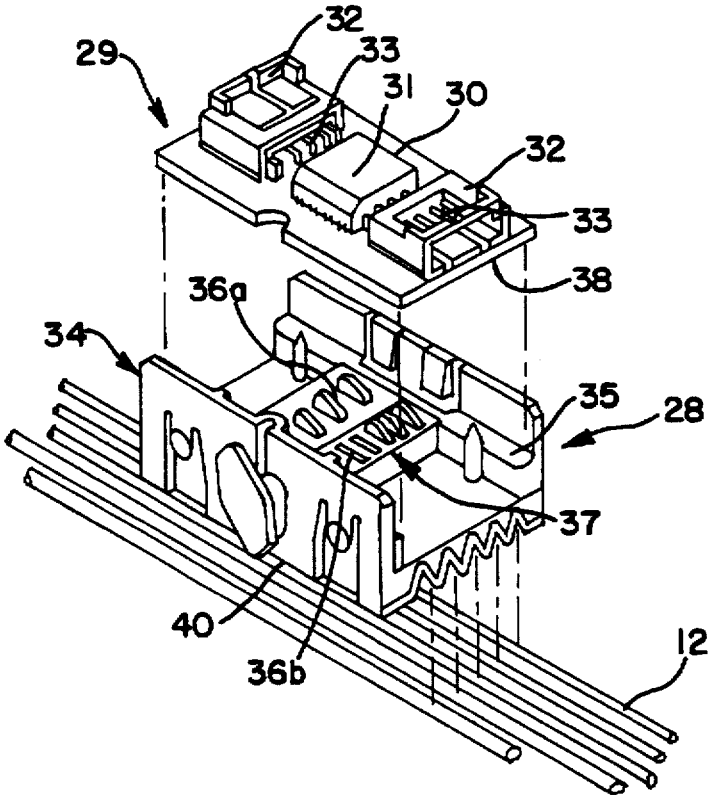

WIRE HARNESS TERMINATION APPARATUS FOR PROGRAMMABLE CONNECTORS

BACKGROUND OF THE INVENTION

The present invention relates generally to the assembly of wire harnesses, and more particularly, to an improved method and apparatus for assembling wire harnesses utilizing multiple, different connector elements terminated to the harness wires at different distances along the wires.

Wire harnesses and cable assemblies are used in numerous consumer electronic products, such as televisions and computers. Wire harnesses are also used in many larger applications, such as in automobiles and are also used in numerous industrial control applications, such as in photocopying machines. Wire harnesses may take a variety of forms, ranging from a single wire interconnecting two connector elements, to a multiple wire harness in which multiple wires extend between opposing connector elements. Other wire harness styles may include "daisy-chain" style harnesses in which the harnesses include multiple wires and multiple connectors terminated to the wires of the harness at different intervals therealong.

Although wire harnesses may be assembled manually, automated production of wire harnesses is preferred from a cost and quality standpoint. Wire harnesses are typically assembled in automated production by attaching, or terminating, connector elements to opposing free ends of wires. When terminating multiple wire and connector harnesses, termination of the connectors is usually performed sequentially at different locations.

In terminating wire harnesses with only two connectors at opposite ends of the harness wires, the wires of the harness are advanced to, or remain at, a first termination location. A first connector element is terminated to a first set of free ends of the harness wires to form a partial wire harness assembly, which is advanced along a harness feedpath to a second termination location. At this second termination location, the harness wires are cut to form a second set of free wire ends which lie opposite the first set of free wire ends and a second connector element is thereupon terminated to the second set of free wire ends.

This process is sequentially repeated for each successive wire harness. In order to apply connectors to the wires of the harnesses at intermediate locations of the harnesses, that is, between the opposing end connectors of the harnesses, the intermediate connectors must be terminated separately at different locations. The termination of these intermediate connector elements may be accomplished by manual termination after the connector elements are terminated to the opposing ends of the harness wires.

Additionally, certain wire harnesses, such as those used in photocopying machines and computers, utilize modular connector elements, referred to in the art as input-output connectors. These connectors have a connector housing module and a printed circuit board module with an integrated circuit chip coupled thereto. These modular, input-output connectors include a plurality of individual spring contact terminals, sometimes formed on a bus strip which is mounted in the connector housing module. These connectors may be "programmed" to provide an unique circuit "address" for each connector. This programming requires bending or breaking selected spring contact terminals so that they will not engage certain circuit traces on the circuit board module when the modular connector is assembled. This programming is done prior to assembling the circuit board module into engagement with the connector housing module. This need for programming complicates the assembly of wire harnesses using such input-output connectors.

Methods and apparatus for the assembly of wire harnesses, and particularly multiple wire harnesses, are known in the prior art. Typically, one or more connector housings are fed from a supply of connector housings into position for termination to one end of the harness wires, and the connector housings are subsequently terminated to the wire ends. The wires are then advanced and cut off to define a desired length for the wire harness, and a second set of connector housings are then terminated thereto. The termination of the first and second connector housings is commonly performed in serial order, such as described in U.S. Pat. No. 4,087,908, issued May 9, 1978 to the assignee of the present application. Wires are advanced along a path into engagement with a first connector housing, the first connector housing is terminated to the first wire end, the wire is further advanced and cut to define a second end, which is then terminated to a second connector housing. Although quite capable of terminating single wire assemblies, the apparatus described in this patent does not adequately provide for the termination of multiple wires, let alone the termination of end and intermediate connector elements to multiple wires.

U.S. Pat. No. 5,471,741, issued Dec. 5, 1995 and assigned to the assignee of the pending application, describes an automated wire harness termination machine for making multiple wire harnesses using two termination stations arranged in-line in a path perpendicular to the harness wire feedpath. Termination in this fashion effectively precludes automated termination of intermediate connector elements. Any intermediate connector elements must then be terminated manually to the harness wires and this additional manual termination decreases the efficiency of automated production.

It is therefore desirable to apply connector elements in serial fashion to multiple wires of a wire harness in serial order to thereby produce multiple wire harnesses having multiple connector elements terminated thereto in spaced-apart order along the length of the wire harness. It also becomes desirable to terminate, either at intermediate locations or at a specific end location, uniquely programmed modular connector elements to the harness wires with the modular connector portions being assembled together while being terminated to the wire harness. It becomes further desirable to test the electrical continuity of the wire harness whenever a connector element is terminated thereto in order to ensure the integrity of the wire harness so that a defective harness and/or connector element may be detected during production so that and further assembly of the harness may be aborted.

Accordingly, the present invention is directed to an apparatus and methods for the automated production of daisy-chain style wire harnesses in which different connector elements are terminated to multiple harness wires in serial order which increases the speed and reliability of production of the harnesses.

It is therefore an object of the present invention to provide a new and improved wire harness fabrication apparatus which overcomes the aforementioned disadvantages of the prior art.

It is another object of the present invention to provide an apparatus for producing multiple wire harnesses having a plurality of connector elements terminated thereto in which the connector elements are chosen from respective supplies of discrete first, second and third connector elements.

It is still another object of the present invention to provide an apparatus for terminating at least three different connector elements to multiple wires of a wire harness, in which the apparatus includes three discrete feed assemblies adapted to feed the individual, discrete connectors from their respective supplies, a single termination assembly which is adapted to terminate each of the discrete connectors to the multiple wires of the harness while maintaining the order of the wires, and a transfer assembly which transfers the harness wires along a harness feedpath after each discrete termination.

It is yet another object of the present invention to provide a method for assembling multiple wire harnesses in which: a first connector element is terminated to a first set of free ends of multiple harness wires to form a first partial wire harness assembly; the harness wires are advanced a first predetermined length; a second connecter element is terminated to the multiple harness wires to form a second partial wire assembly; the harness wires subsequently advanced a second predetermined length; and, a third connector element is terminated to a second set of free ends of the wire harness to define a completed wire harness assembly.

It is a further object of the present invention to provide a wire harness fabrication apparatus which is capable of terminating at least three different style connector elements to multiple wires in serial order utilizing a single termination station and in which the fabrication apparatus include means for testing the electrical continuity of the harnesses when each connector element is terminated to the wires of the harness.

Yet still another object of the present invention is to provide a wire harness assembly apparatus for producing wire harnesses by terminating modular connector elements thereto, the modular connector elements having interengaging first and second connector portions, the apparatus having means for advancing the first and second connector portions to a terminations station, the apparatus further including first termination means for terminating the first connector portion to the multiple wires of the harness and second termination means for terminating the second connector portion to the first connector portion without disrupting the order of the harness wires.

SUMMARY OF THE INVENTION

The present invention accomplishes these objects and provides a new and improved a wire harness-making machine and methods for making wire harnesses in which the wire harnesses have at least two different connector elements terminated thereto in different locations along the length of the wire harnesses.

In accordance with the preferred embodiment of the present invention, the apparatus includes a wire feed mechanism which advances a plurality of wires in side-by-side order from individual wire supplies to a wire clamp that directs the wires to a termination station and also serves to define a wire feedpath for the apparatus with five such wires being contemplated in the preferred embodiment. Various discrete connector elements are terminated to the wires in serial fashion at the termination station as the harness wires are advanced to define successive preselected wire lengths between successive connector elements.

In order to effectuate the termination of the different types of connector elements, the present invention contemplates the use of a plurality of connector element advancement means corresponding in number to the different types of connector elements intended to be terminated to the wire harness. A first connector element advancement means is therefore spaced apart from the termination station, preferably downstream thereof and in alignment with a wire harness carriage assembly that includes a reciprocatable nest which receives a lead connector element therein. The nest reciprocates along the wire harness feedpath and carries the lead connector element from its associated advancement means to the termination station where the harness wires are fed into engagement therewith and terminated thereto. The carriage assembly thereupon moves downstream along the harness feedpath to pull preselected lengths of harness wires through the termination station while subsequent connector elements are terminated to the harness wires.

The connector elements utilized in conjunction with the apparatus of the present invention are preferably of the insulation displacement termination style and some of the connector elements are of modular construction. These modular connector elements have two opposing interengaging connector portions in the form of a circuit board module and a connector housing module. The connector housing modules include a plurality of electrical contact terminals which may be selectively positioned therein so that the contact terminals lie in or our of contact with opposing circuit traces on the circuit board modules. The present invention includes a means for selectively positioning, or "programming", these contact terminals within the connector housing modules prior to the termination thereof to the harness wires.

The present invention include means for advancing the two connector modules from different directions to the termination station in order to facilitate the programming of the connector housing modules away from the wire feedpath. The programming means includes a programming member having a plurality of selectively actuatable pins which are brought into contact with the contact terminals of the connector housing module. The stroke of each pin may be selectively automatically adjusted prior to engagement with the connector housing module so that only specific contact terminals are moved into positions where they will not make contact with the circuit board module after assembly of the circuit board module into the connector housing module. In this regard, the present invention provides means for uniquely programming each such modular connector prior to its termination to the harness wires.

Inasmuch as the apparatus of the present invention is capable of producing wire harnesses having lengths of between 6 inches and 120 inches, at least one harness wire taping means is provided downstream of the termination station and proximate to the harness feedpath. The taping means includes a taping mechanism which is selectively movable into the harness feedpath and engageable with the harness wires to apply a length of wire bundling tape thereto. Additional wire taping means may be provided and disposed at subsequent locations downstream of the termination station along the harness feedpath. These wire taping means may further include a marking means, such as a mechanical dot matrix printing mechanism, which applies an identifying indicia to one of the wire harness bundling tapes so that each harness produced on the apparatus may be identified.

A third connector element advancement means is provided in the present invention and is spaced apart from the wire feedpath and termination station. This third connector element advancement means (as may the first and second connector element advancement means) may utilize a connector element marking means for marking an identifying indicia onto surfaces of the third connector elements as they are fed from a supply of connector elements along an advancement path to the termination station so that in harness completed by the apparatus, each connector element may be marked with a unique identifying number.

The termination station of the present invention is provided with a reciprocating termination head assembly which includes a wire comb assembly, a severing knife and a plurality of wire guides. The wire comb assembly and the wire guides cooperate to engage the harness wires in locations fore and aft of each connector element during termination so that the proper wire side-by-side spacing of the harness wires is maintained.

In the preferred embodiment, the wire comb assembly is disposed beneath the level of the wires in the wire feedpath and is selectively vertically reciprocatable into and out of contact with the harness wires and connector elements present in the termination station. The wire comb assembly has a series of open slots formed therein which are aligned with complementary wire punches so that when a modular connector element is positioned over the wire comb assembly, it may be lowered to expose the wire punches through the open slots into contact with the harness wires to thereby force them into wire-receiving openings on the underside of the modular connector element.

The termination head assembly further include a movable shelf which reciprocates over the comb assembly during cutoff of the harness wires and termination of the trailing connector element for each wire harness. The shelf provides a flat support surface for the last terminated connector element and prevents the last connector element and harness from catching on or otherwise engaging any portion of the comb assembly which might impede advancement of the completed apparatus out of the termination station.

The present invention still further includes a means for ejecting and arranging the completed harness in harness support racks by providing an ejection station aligned with, but spaced apart from the first connector element advancement means to define an opening into which the carriage nest moves. When a wire harness is completed, the carriage nest is moved into the ejection station opening and the leading connector element of the wire harness is pushed out of the carriage nest and into a collection channel which is removably mounted on a harness collection support frame which may be easily removed and replaced when it is filled.

Still further, the present invention advantageously provides a means for sequentially testing the electrical integrity of the harness wires and connector elements at each and every termination. This testing means includes a plurality of electrical probes disposed in the carriage nest which are received within the first connector element connector openings so that they make electrical contact with the terminals within the first connector element. The termination head assembly includes a plurality of similar probes, or contacts, that engage the terminals of each connector element terminated in the termination head assembly, so that during termination, a potential may be applied to the probes in the carriage nest and read at the termination head assembly to determine the presence of an open circuit which may be due either to a defective connector element of harness wire. When such a defect is detected, continued termination of the wire harness may be stopped and the harness rejected, thereby increasing the efficiency of operation of the apparatus.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of this description, reference will be frequently made to the attached drawings in which:

FIG. 5 is a perspective view of a fourth style of wire harness produced by the wire harness-making apparatus of FIG. 1;

FIG. 6 is a exploded view of a modular connector element utilized in the wires harnesses of FIGS. 2–5 and applied to wire harnesses by the wire harness-making apparatus of FIG. 1;

FIGS. 8A–8K are schematic elevational views generally illustrating the sequence of operation for termination of a wire harness in which FIG. 8A illustrates the step of loading of a lead connector element into the wire harness transfer carriage nest;

FIG. 8B illustrates the steps of moving the wire harness transfer carriage nest into position in the termination assembly and terminating the lead connector element to the harness wires at the leading ends of the harness wires;

FIG. 8C illustrates the steps of advancing the harness wires by moving the carriage nest downstream and terminating a modular connector element lower connector module to the harness wires at a second discrete location;

FIG. 8D illustrates the steps of taping the harness wires together at a location downstream of the termination station and positioning a connector element upper module over the lower module;

FIG. 8E illustrates the step of completing the assembly of the modular connector element by applying the connector element upper module to the connector element lower module;

FIG. 8F illustrates the step of advancing the harness wires a second predetermined length to advance the modular connector element out of the termination station;

FIG. 8G illustrates the steps of terminating an additional modular connector element to the harness wires and applying a second length of bundling tape the harness wires downstream of the termination station and second modular connector element;

FIG. 8H illustrates the steps of advancing the harness wires another predetermined length and terminating a fourth connector element to the harness wires;

FIG. 8I illustrates the steps of advancing the harness wires for a last predetermined length and terminating a fifth connector element to the harness wires, while bringing a labeling means into position with the harness wires near the transfer nest and cutting the wires near the fifth connector element;

FIG. 8J illustrates the step of moving the harness wires rearwardly to a ready position for start of the next harness assembly cycle;

FIG. 8K illustrates the steps of applying an identification label to the harness and releasing the last terminated connector element from the termination station;

FIG. 23 illustrates the harness assembly carriage in place within the termination station in a position for termination of the leading harness connector element and further illustrating the modular connector lower module feed assembly;

FIG. 24 illustrates the termination of a mini-fit style connector element to the harness wires with the harness wires being supported by a wire guide;

FIG. 25 illustrates the upper termination head cutting off the wires after a modular connector element and the shelf assembly in position underneath the connector element to catch it;

FIG. 26 illustrates the harness wires protruding from the wire clamp after cutting and in a ready position for the assembly of another connector element.

DETAILED DESCRIPTION OF THE PREFERRED EMBODIMENTS

The present invention is directed to an apparatus for the automated production of wire harnesses in which different connector elements, such as male and female interface connector elements and modular connector elements, are successively terminated in serial order to the multiple wires.

The detailed description of the present invention to follow will first describe the structure of wire harnesses made on the present invention, then describe the operation of the harness-making machine, and then describe the individual processing stations of the wire harness-making machine. Although the present invention may be used to assemble a variety of different style and size wire harnesses using a variety of connector elements, the following detailed description will utilize connector elements as illustrated in FIGS. 2–5. The use of these particular connector elements is for purposes of example only and it will be understood that the present invention is not be limited to operation and use with the specific connectors illustrated herein. Other connectors may be suitably used therewith and equivalent results and benefits obtained.

Wire Harnesses Produced by the Harness-Making Machine

Figure 1:
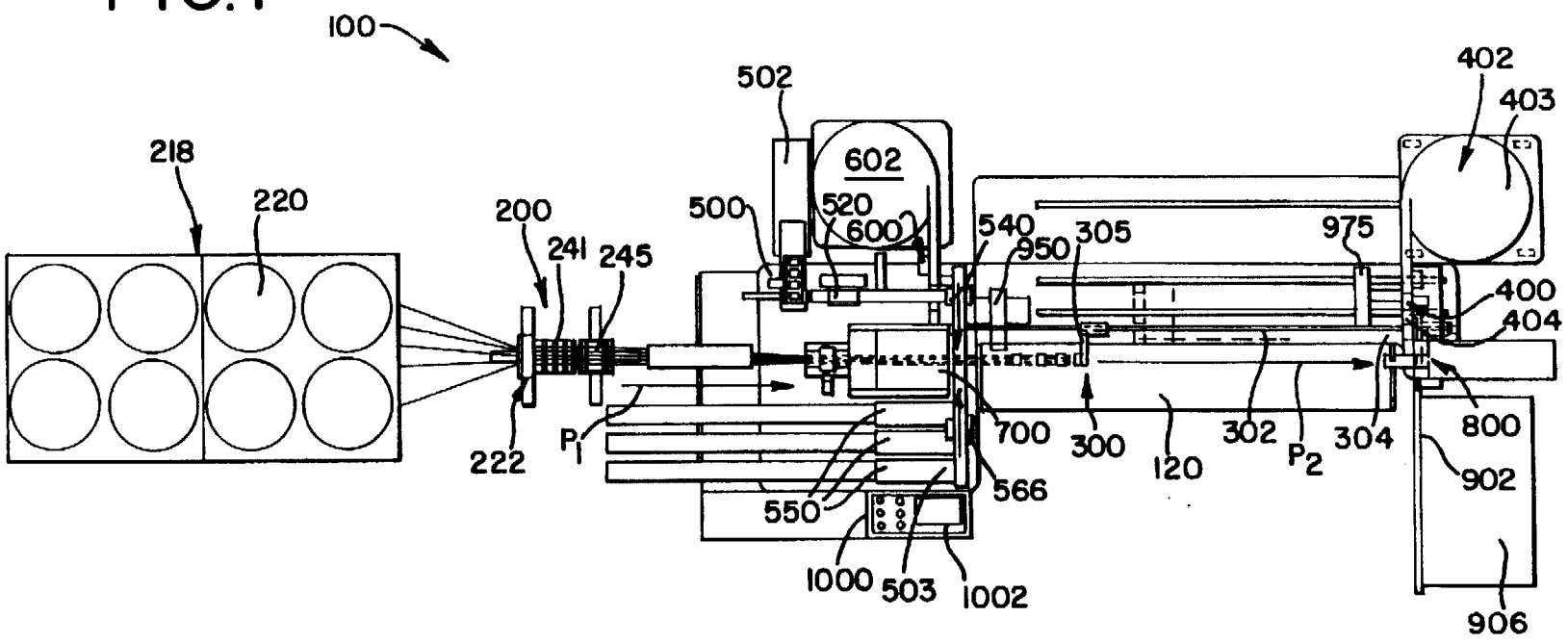
FIG. 1 is a plan view of a wire harness-making apparatus constructed in accordance with the principles of the present invention.
Figure 2:
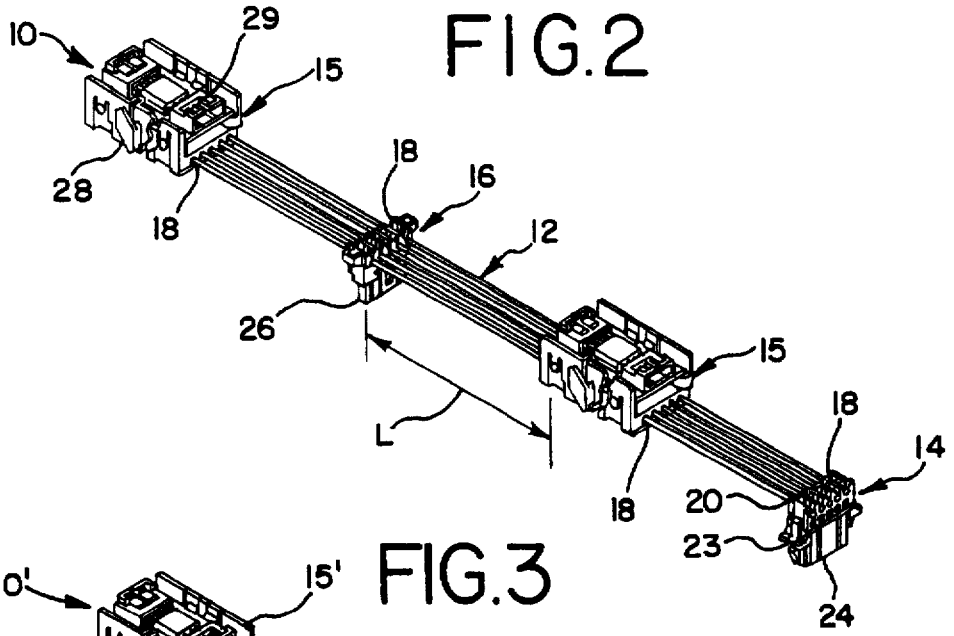
FIG. 2 is a perspective view of one style of wire harness produced by the wire harness-making apparatus of FIG. 1.

FIG. 2 illustrates a wire harness 10 produced on a wire harness-making apparatus 100 (FIG. 1) constructed in accordance with the principles of the present invention. The wire harness 10 is generally of the type which has a plurality of spaced-apart wires 12 which extend for a predetermined length L. A plurality of different electrical connector elements 14, 15 and 16 are terminated to the wires 12 of the harness 10 at predetermined spacing intervals. The connector elements 14, 15 & 16 are similar in that they all rely upon insulation displacement to effect termination, and accordingly, each connector elements has wire-receiving openings 18 which receive the harness wires 12 therein. Electrically conductive contact terminals (not shown) are disposed within these wire-receiving openings 18 so that when the harness wires 12 are pressed into the wire-receiving openings 18 of the connector elements 14–16, the contact terminals pierce the outer insulation layer of the wires 12 to electrically engage the inner conductor portions and establish a reliable electrical connection in a manner well known in the art.

Returning to FIG. 2, the harness 10 shown therein includes a male connector element 14 terminated to one set of free ends 20 of the harness wires 12, shown at the lower right of FIG. 2 at the leading end of the harness 10. The male connector element 14 includes an insulative housing defining a connector body portion 23. The connector body portion 23 encloses a series of internal contact terminals in the form of pins or blades which extend in the body portion to near a set of opening located along at the bottom edge 24 of the male connector element 14. These contact pin terminals engage complementary receptacle terminals of a corresponding female connector element 16 which extend within openings of a body portion 27 of the female connector element 16, one such connector element 16 being shown terminated as third in line along the harness 10 of FIG. 2. Thus, it will be understood that in the context of this detailed description, the gender, of the connector element, i.e., male or female, is dictated not by the connector housing structure, but rather by the shape of its internal contact terminal.

The harness 10 of FIG. 2 further includes two modular connector elements 16 terminated thereto. These connector elements are referred to as "modular" in this detailed description because they include two connector components, or modules 28, 29, that interengage each other to form the completed connector element 15. Examples of such connector elements are aptly described in U.S. Pat. Nos. 5,125,846 and 5,312,261, which are owned by the assignee of the present invention and details of which are incorporated herein by reference.

Figure 7A:
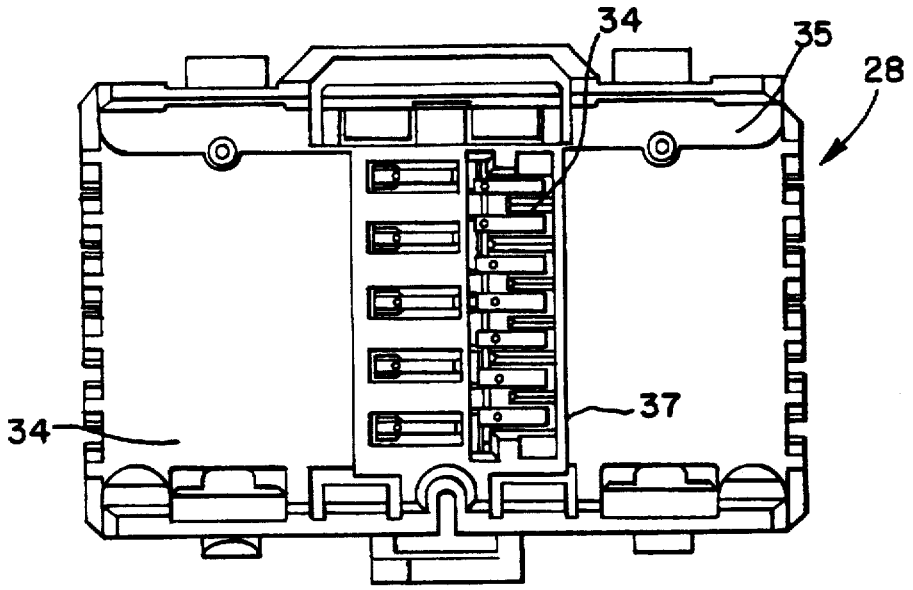
FIG. 7A is a top plan view of the lower connector module, or connector housing, of the modular connector element of FIG. 6 taken along lines A—A thereof, illustrating the arrangement of the programmable contact terminals thereof.
Figure 7B:
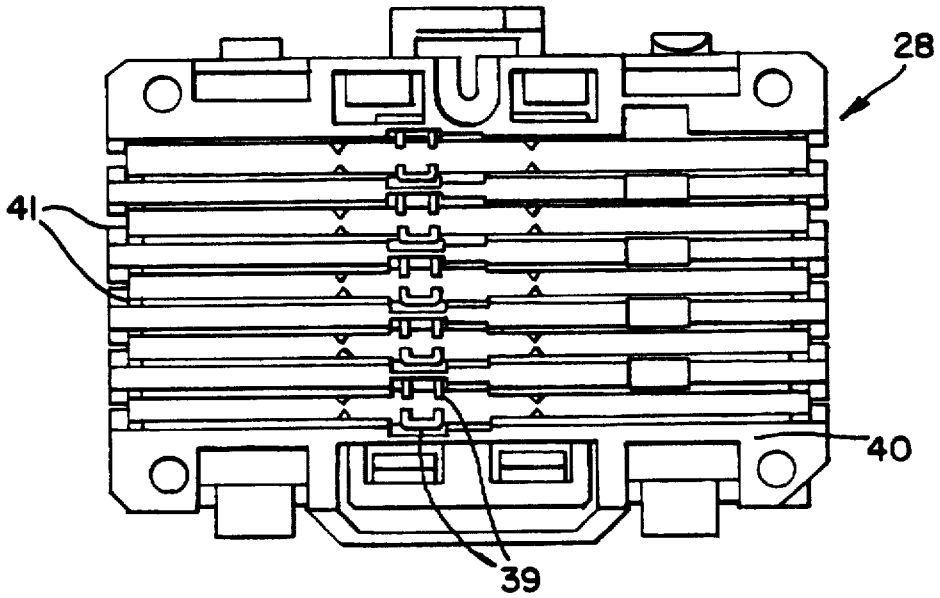
FIG. 7B is a bottom plan view of the lower connector module of the modular connector element of FIG. 6 taken along lines B—B thereof, illustrating the wire-receiving channels and insulation displacement terminals thereof.

The upper connector element module 29, as seen best in FIG. 6, includes a printed circuit board 30 having a plurality of circuit traces thereon, a integrated circuit chip 31 and a pair of header connectors 32 with contact pins 33. The lower connector element module 28 includes a plastic housing 34 having a support base 35 defined therein which supports the upper module circuit board 30. The connector housing 34 contains two sets of conductive, cantilevered contact spring terminals 36*a*, 36*b* in the central portion 37 of the connector housing 34. (FIG. 7A.) Both sets of spring terminals 36*a*, 36*b* initially extend above the level of the central portion 37 so that they will contact circuit traces disposed on the opposing surface 38 of the upper module circuit board 30. The first set of contact spring terminals 36*a* extend into contact with insulation-displacement terminals 39 that are held in the bottom portion 40 of the connector module 28 in alignment with a plurality of wire channels 41 formed therein. As seen in FIG. 6, termination of the lower connector element module 28 is effected by pressing the harness wires 12 into the wire channels 41 so that the insulation-displacement terminals 39 cut into the wire insulation and contact the internal conductors of the wires as is well known in the art. The other set of contact spring terminals 36*b* are interconnected to a bus strip and these terminals 36*b* may be "programmed" as explained in greater detail below not to extend into contact with the circuit traces of the circuit board module 30.

Figure 3:
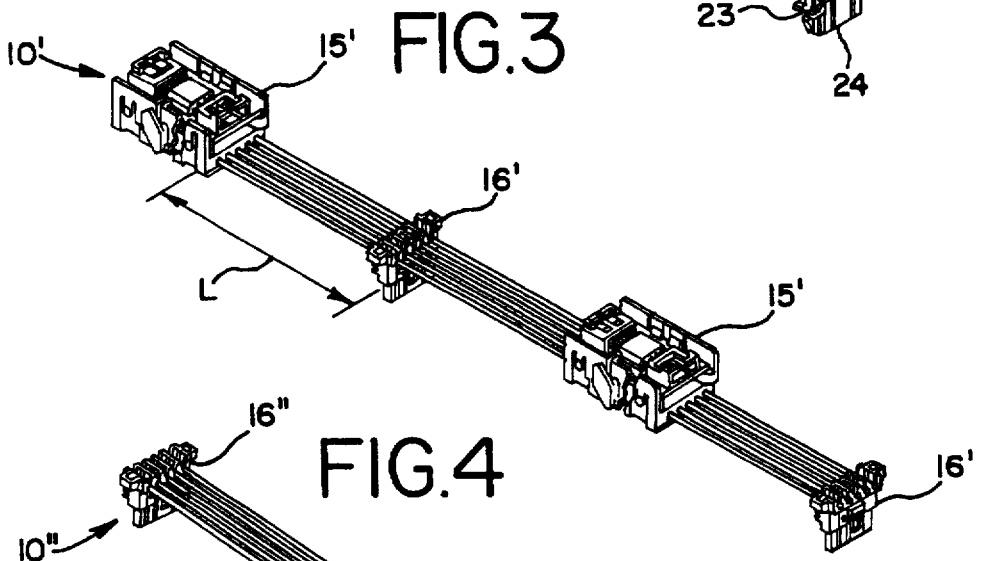
FIG. 3 is a perspective view of a second style of wire harness produced by the wire harness-making apparatus of FIG. 1.
Figure 4:
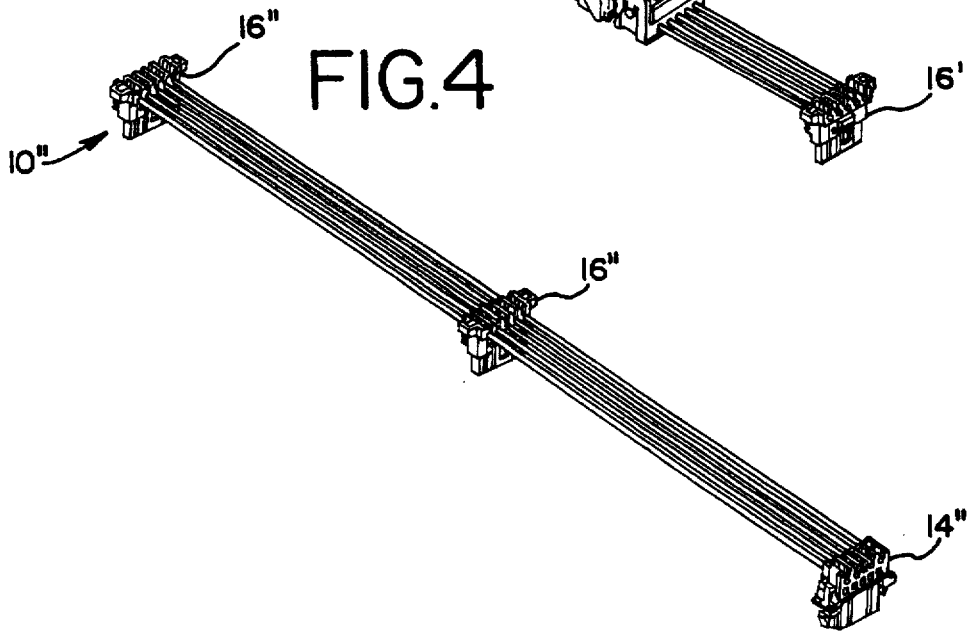
FIG. 4 is a perspective view of a third style of wire harness produced by the wire harness-making apparatus of FIG. 1.

FIG. 3 illustrates another wire harness 10' which has a female connector element 16' terminated to its leading end, followed by a modular connector element 15', another female connector element 16' and ending with another modular connector element 15'. FIG. 4 illustrates a third style of wire harness 10" which has three connector elements 14" and 16" shown terminated thereto, with the leading connector element 14" being a male connector element and the two subsequent connector elements 16" being female connector elements.

FIG. 5 illustrates still another style of wire harness 10'" which may be produced by the apparatus of FIG. 1 illustrating how the harness, if desired, may be made with a set of wire free ends 19 at its trailing edge 21.

It will be understood that the harness depicted in FIGS. 2–5 are merely exemplary of the styles of wire harnesses which may be produced utilizing various connector elements and are not intended to be limiting. As will be explained in further detail to follow, the present invention also has the capability of applying lengths of tape to the harness wires 12 at locations intermediate the connector elements 14–16 during the fabrication of the harness.

Overall Operation of the Wire Harness-Making Machine

FIG. 1 illustrates a wire harness-making machine of the present invention, while FIGS. 8A–8K generally illustrate the sequence of steps involved in the operation of the machine 100 in the assembly of wire harnesses, such as those illustrated in FIGS. 2–5. The wire harness-making machine 100 produces the harnesses 10 by first terminating a leading, or first, connector element to first ends of a set of harness wires 12 (five such wires being shown in FIGS. 2–5 arranged in side-by-side order). Some applications of wire harnesses that utilize modular input-output style connectors dictate that different gauge wires be used in the harnesses. The two leftmost wires 50, 51 in the wire harnesses shown in FIGS. 2–5 are of a larger gauge than the remaining three wires 52.

Once a leading connector element is terminated to the harness wires 12, a partial wire harness assembly 101 is formed and this assembly 101 is advanced along a wire harness feedpath $P_2$ by a reciprocating carriage nest assembly 300 which moves downstream in predetermined movements corresponding to the desired length L between successive connector elements on the wire harness 10.

Subsequent connector elements which may take the form of male connector elements 14, modular connector elements 15 or female connector elements 16 are applied to the harness wires 12 at a first work station which in essence, is a termination station wherein the connector elements are applied and terminated to the harness wires. The connector elements 14–16 are advanced from respective supplies 402, 502, 503, 602 thereof by respective connector element advancement or feed assemblies 400, 500 & 600 into position into either a termination station 700 in the first work station or the carriage nest assembly 300. The modular connector elements 15 need to be assembled from their constituent first (lower) and second (upper) modules and thus, the modular connector element supply includes respective different supplies 502, 503 of the two modules 28, 29. The two modules 28, 29 are preferably fed to the termination station from opposing directions and on opposite sides of the wire feedpath $P_1$ and the wire harness feedpath $P_2$ in order to more effectively integrate the assembly of the modular connector elements 15 into the termination station 700.

Once the final connector element is terminated to the harness wires 12 the carriage nest assembly moves into alignment with a harness ejection assembly 800 that ejects the harness leading connector from the carriage nest into a harness handling assembly 850 where completed harnesses are collected and removed for packaging, shipment or other processing. As the carriage nest assembly moves along the wire harness feedpath $P_2$, selected lengths of tape 955 may be applied to the harness wires 12 at preselected locations. The tape may also include identifying machines to identify each harness with a unique identification number.

Throughout the assembly process and in particular, at each termination, the wires and connector elements of the harness being assembled is tested for electrical integrity. This is accomplished by engaging the internal contact terminals of the leading connector element of the wire harness 10 with probes, or contacts 329 disposed in the carriage nest and applying an electrical potential thereto. A second set of probes are disposed the termination assembly and engage the internal contact terminals of subsequent connector elements applied to the harness wires 12 regardless of the type of connector element used.

Returning to FIGS. 8A–8K and in particular 8A, a leading connector element 14 is loaded into the carriage nest assembly and a set of harness wires 12 are fed through a wire guide, shown as a wire clamp 120. The carriage nest assembly is positioned along the wire harness feedpath $P_2$ in opposition to the first work station.

Figure 8A:
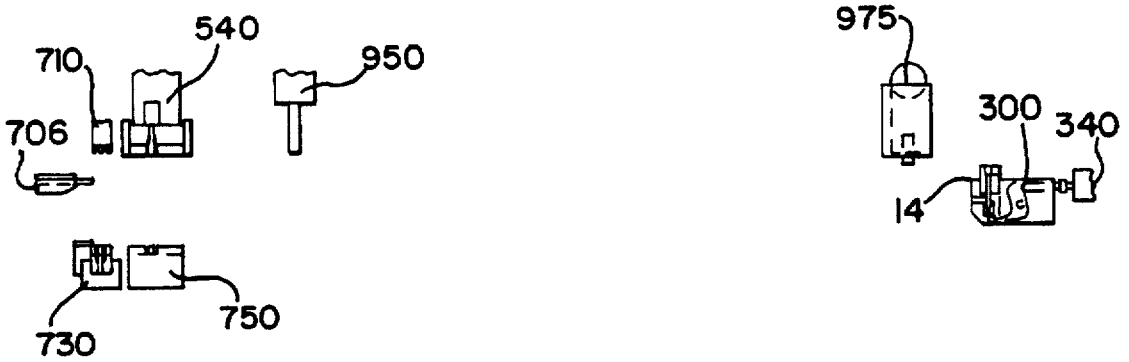
Figure 8B:
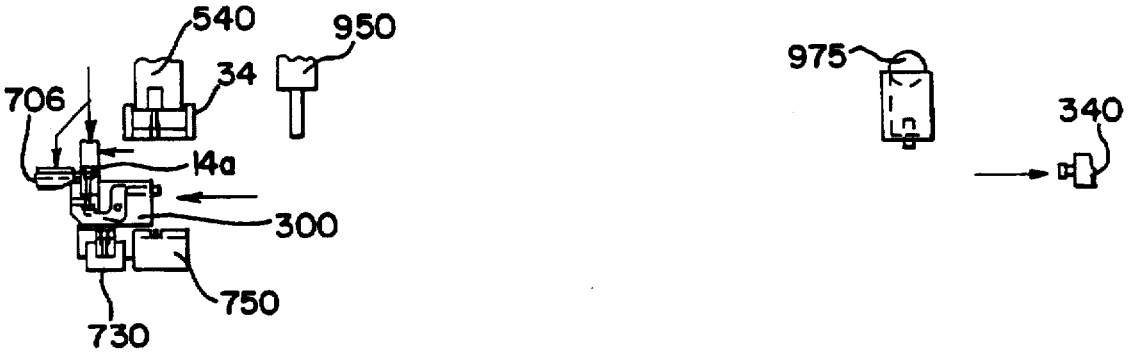
Figure 8C:
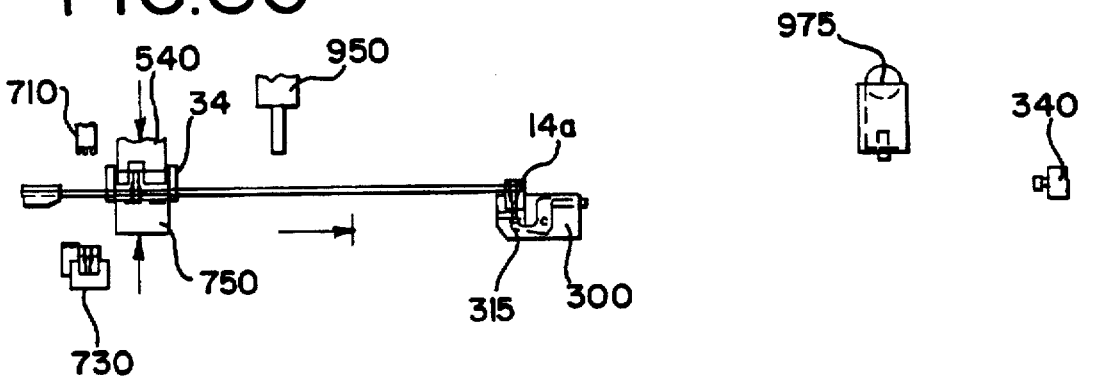

The carriage nest assembly, as illustrated in FIG. 8B moves into the first work station and into position with the termination assembly thereof so that the free ends of the wires 12 which project from the wire clamp 125 are aligned with the appropriate wire-receiving openings of the leading connector element. The termination assembly is then activated to terminate the leading connector element to the free ends of the harness wires 12. While this is occurring, a modular connector element advancement means engages one of the connector element modules, (the lower module 28 being illustrated) and brings it toward the termination assembly.

Figure 8D:
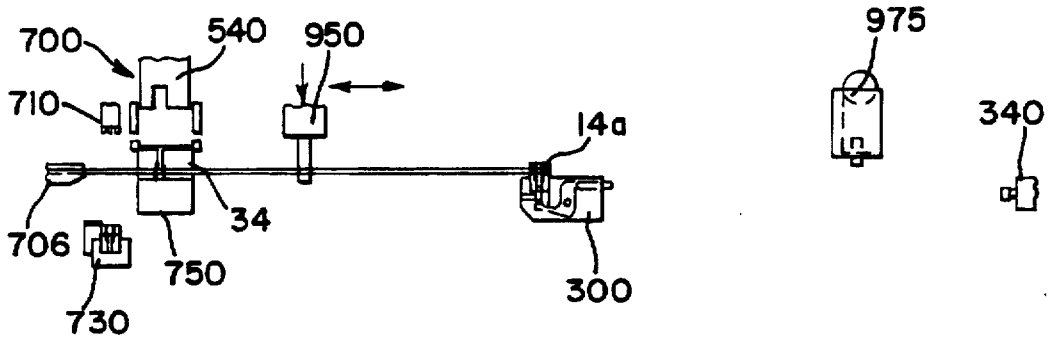

The termination head releases the leading connector and the carriage nest assembly moves downstream along the wire harness feedpath for a distance L and the lower module 28 of the modular connector element is applied to and terminated to the harness wires 12. (FIG. 8G). After termination, as illustrated in FIG. 8D, a taping means is activated and moved, if desired, to a specific taping location along the wire harness feedpath where it is brought into engagement with the harness wires to wrap a length of tape 955 around the wires.

Figure 8E:
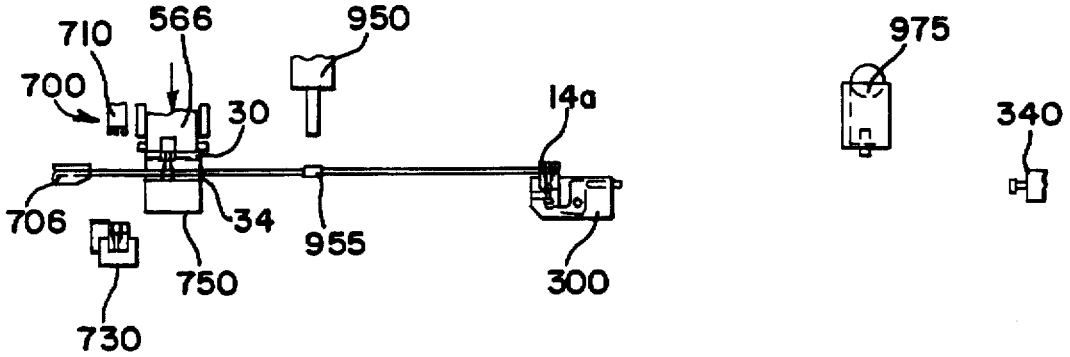
Figure 8F:
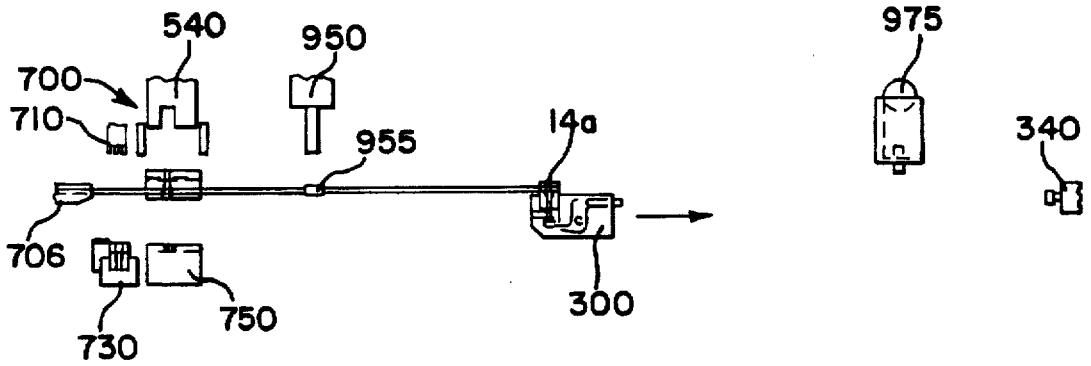
Figure 8G:
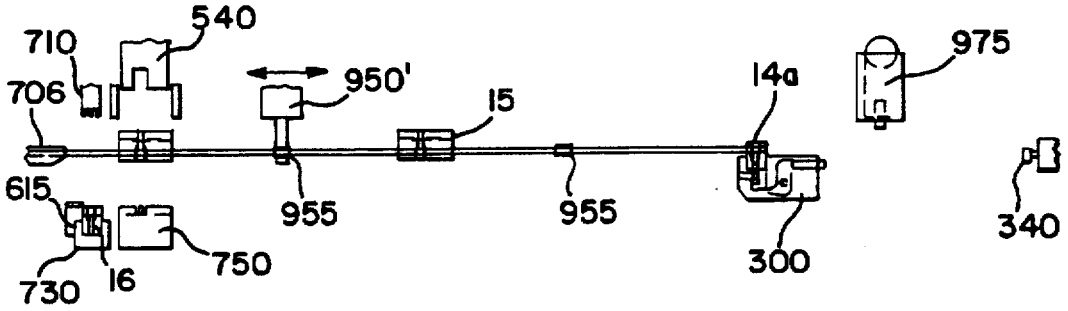
Figure 8H:
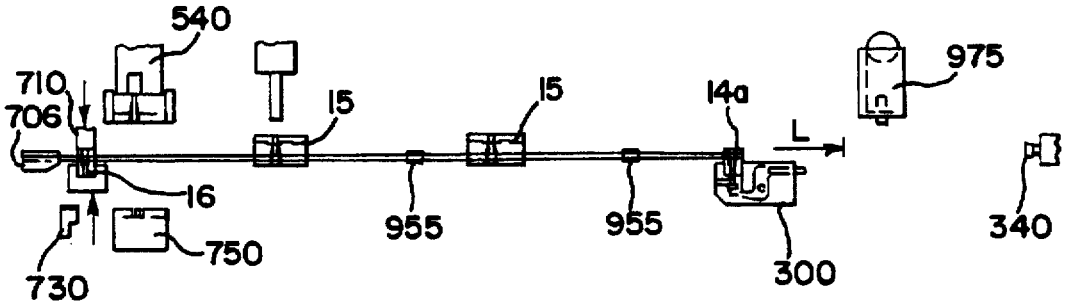

Next, as shown in FIG. 8E, an upper module is brought into position in the termination assembly and applied to the lower module. Once the two modules are engaged, the termination head is withdrawn and the carriage nest assembly 300 advances another predetermined distance downstream of the termination station. (FIG. 8F.) FIG. 8G illustrates the application of another modular connector element and a second length of tape therebetween. Another connector element is advanced to the termination assembly and applied to the wires as shown in FIG. 8H and after its termination, the transfer nest advances another preselected distance L.

Figure 8I:
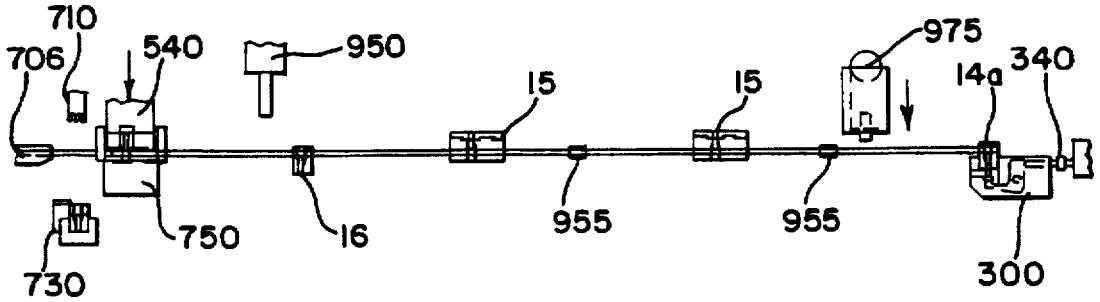
Figure 8J:
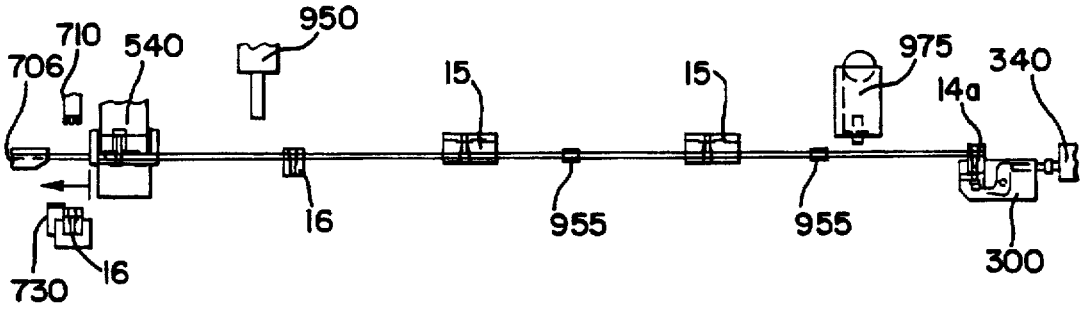
Figure 8K:
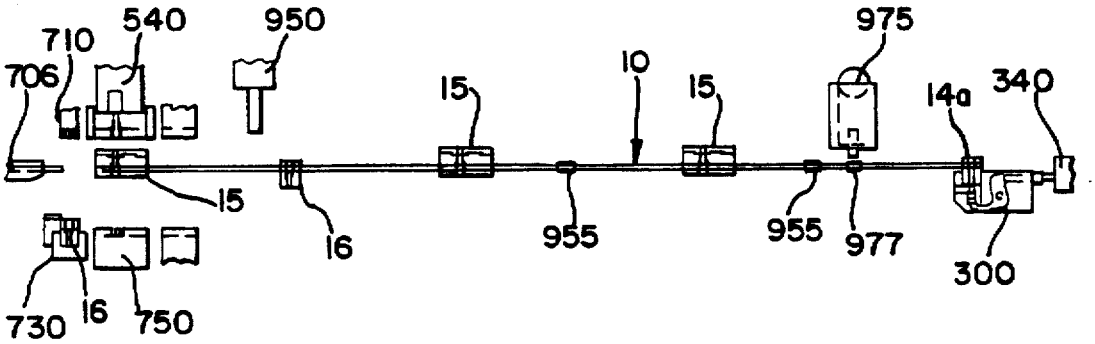

A final, or trailing connector 15 in the form of another modular connector is brought to the termination assembly and applied to the wires, while a marking taper 975 is brought into position along the wire harness feedpath, as illustrated in FIG. 8I, and a wire harness identification label 977 is applied by it to the wire harness 10. Because it is desirable not to have loose wire ends extending out of the modular input-output connectors used with the present invention, the harness wires are severed at the termination head and they are drawn rearwardly within the wire clamp so they are in position for the next harness termination as shown in FIG. 8J. FIG. 8K illustrates the release of the harness trailing connector and application of an identification tape to the harness wires.

Wire Dispenser Assembly

Figure 9:
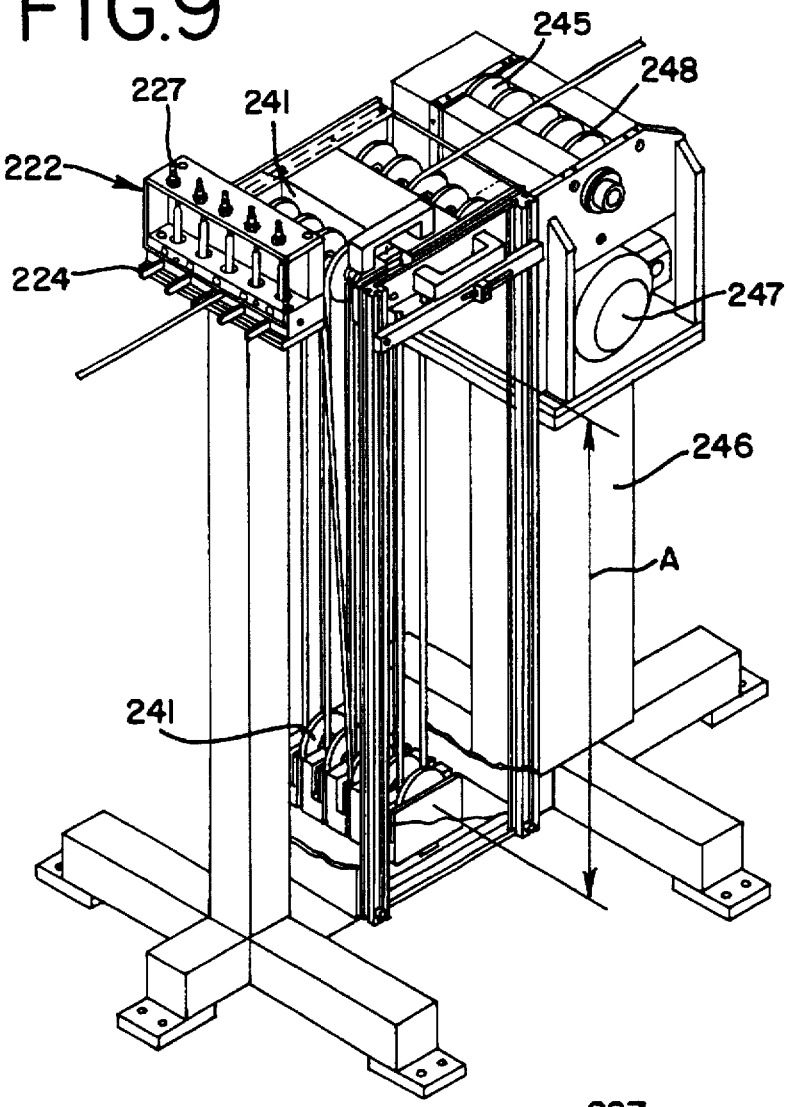
FIG. 9 is a perspective view of an wire dispenser assembly used to feed individual wires for the wire harness-making apparatus of FIG. 1.
Figure 10:
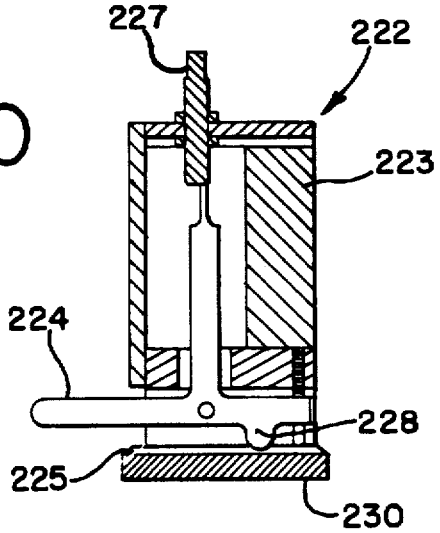
FIG. 10 is a partial cross-sectional view of the missing wire, wire splice and wire size detector assembly of the wire dispenser assembly of FIG. 9.
Figure 11:
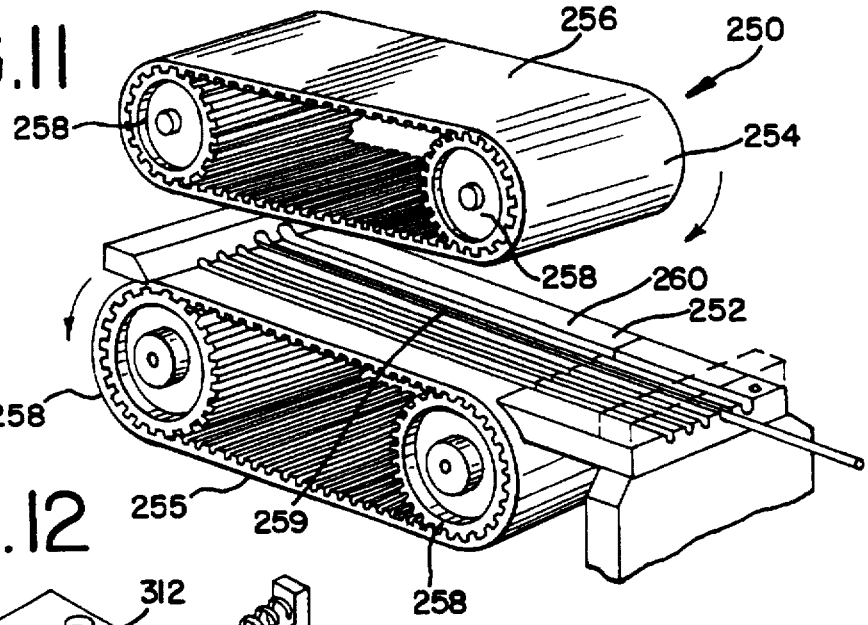
FIG. 11 is a perspective view of one embodiment of a wire feed mechanism which may be used in conjunction with the wire dispenser assembly in the wire harness-making apparatus of FIG. 1.

Turning now to FIGS. 9–11, the structure of the harness-making apparatus 100 shall now be described, beginning with the wire dispenser assembly 200 which examines and feeds a plurality of individual wires 12 from respective wire supplies 218, in the form of wire supply barrels to the termination station of the apparatus 100. Moving downstream of the wire supply 218, the wires 12 pass through a wire detector assembly 222 that detects missing or spliced wires so that the operation of the apparatus 100 may be stopped to prevent the manufacture of a defective wire harness. The wire detector assembly 222 includes an enclosure 223 and a plurality of detector levers 224 supported therein above individual wire tracks 225, the detector levers 224 are pivotably mounted on a shaft 226 which extends widthwise through the enclosure 223. A series of proximity switches 227 are coupled to the detector levers 224 and serve to measure the vertical distance between the base of the wire channels 225 and the wire contact arm 228 of the detector levers 224 in order to determine the correct diameter wire being threaded in the proper wire channel 225. A low voltage may be applied between the detector lever 224 and the base 230 of the detector assembly 222 in order to determine the presence of a splice in the wires in a manner known in the art, i.e. where the voltage drops to a specific value, a splice or missing wire is indicated.

A wire accumulator assembly 240 is located downstream of the detector assembly 222. The accumulator assembly 240 includes a series of wire guide pulleys 241 which are adjustably and vertically spaced apart from each other in order to provide an area where the harness wire may accumulate in a significant length in order to provide a sufficiently long wire length remaining downstream of the termination station when any wire runs out. When the end of any wire reaches the detector assembly 222, the accumulator assembly 240 provides a remaining wire length equal to twice the vertical distance A between the guide pulleys 241. In addition to the accumulating function, the accumulator assembly 240 has a vertically floating pulley 241 associated with each harness wire 12 which rises if the wire tension becomes too high and a specific height to which the pulley 241 rises triggers a photoelectric sensor to signal the apparatus controller that a high wire tension condition exists in one of the harness wires and stop the apparatus, if necessary.

A capstan drum 245 is illustrated in FIGS. 1 & 9 as adjacent and downstream of the accumulator assembly and is rotatably mounted in a support stand 246. The drum 245 is driven by a motor 247 and includes a series of wire-receiving grooves 248 corresponding in number to the number of wires used in the wire harness.

A wire feed assembly 250 may be interposed between the capstan drum 245 and the termination station 700 for driving the harness wires 12 in their travel through the apparatus 100. As shown in FIG. 11, the drive assembly 250 includes a pair of opposing belt mechanisms 252, 254, each having respective drive belts 255, 256 engaged to rotatable drive wheels 258. The bottom drive belt 255 may have one or more semicircular grooves 259 formed in its exterior surface 260 for the purpose of partially receiving the larger diameter wires of the set of harness wires therein. The smaller diameter wires are received on the surface 260 of the drive belt 255. In operation, the upper drive belt 256 is brought into abutting contact with the lower drive belt 255 and the counter-rotation of the two belts 255, 256 causes the drive belts to frictionally engage the harness wires and feed them forward (or downstream) along the wire feedpath $P_1$. Guide blocks 262 may be located at opposite ends of the drive belts to assist in the guiding of the harness wires as they are fed through the apparatus.

A reciprocating wire clamp may be used instead of the drive belt mechanism shown in FIG. 11 and may grip and pull the harness wires 12 in a manner known in the art. The wire drive mechanism of the apparatus need not provide the primary driving force to the wires inasmuch as once the harness wires are terminated to the leading connector in the carriage nest, the carriage will pull the wires from their supplies. The use of a clamp is beneficial when a rearward pulling movement must be exerted on the harness wires, such as in certain terminations when the wires are cut off at a location which does not exceed the trailing edge of the connector, as is shown in the wire harness 10' of FIG. 3.

Wire Harness Carriage Assembly

Figure 12:
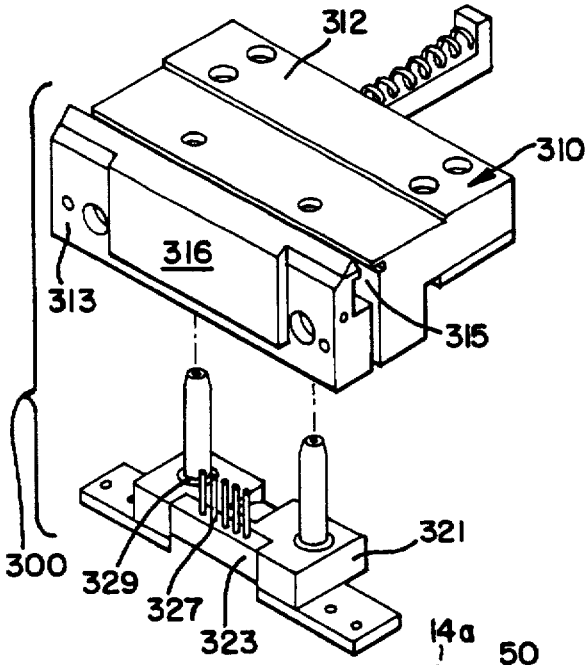
FIG. 12 is a partially exploded perspective view of a wire harness connector element carriage nest used in the wire harness-making apparatus of FIG. 1.
Figure 13:
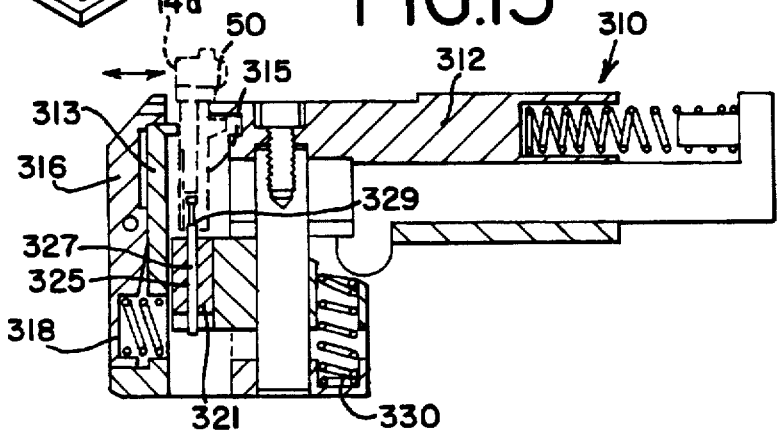
FIG. 13 is a cross-sectional view of the transfer carriage taken along lines 13—13 thereof.

Turning now to FIGS. 12 & 13, a wire harness carriage assembly 300 is illustrated. The carriage assembly 300 is slidably mounted on one or more carriage rails 302 supported on the apparatus frame 304 and extending between the termination station and the leading connector element feed assembly 440 and harness ejection station 800. A carriage stop 340 is preferably disposed on the carriage rails 302 to define the maximum extent of travel of the carriage assembly 300. The carriage assembly 300 includes a reciprocating support arm 305 which engages the carriage rail 302 and supports a connector element nest 310 (FIG. 12). The nest 310 includes a nest block 312 and opposing front cover 313 which are spaced apart from each other to define a connector element-receiving channel, or nest 315, therebetween. A connector element locator bar 316 is pivotally mounted to the front cover 313 and biased with a spring 318 so that it positively engages the leading connector element when the connector element received in the nest channel 315.

In an important aspect of the present invention, and as explained in greater detail to follow, the carriage assembly 300 includes a continuity testing assembly 320 illustrated in FIGS. 12 & 13 as a slide block 321 which supports a probe holder 323 having a plurality of cavities 325 that support cylindrical receptacles 327 which in turn support elongated electrical probes 329. The slide block 321 includes a pair of springs 330 through which the probes 329 are brought into contact with the internal contact terminals 50 of the leading connector element 14*a*. The nest channel 315 is open at its opposing ends to permit a leading connector element to be loaded into it as well as ejected from it by the leading connector element advancement means.

Leading Connector Element Feed Assembly

Figure 21:
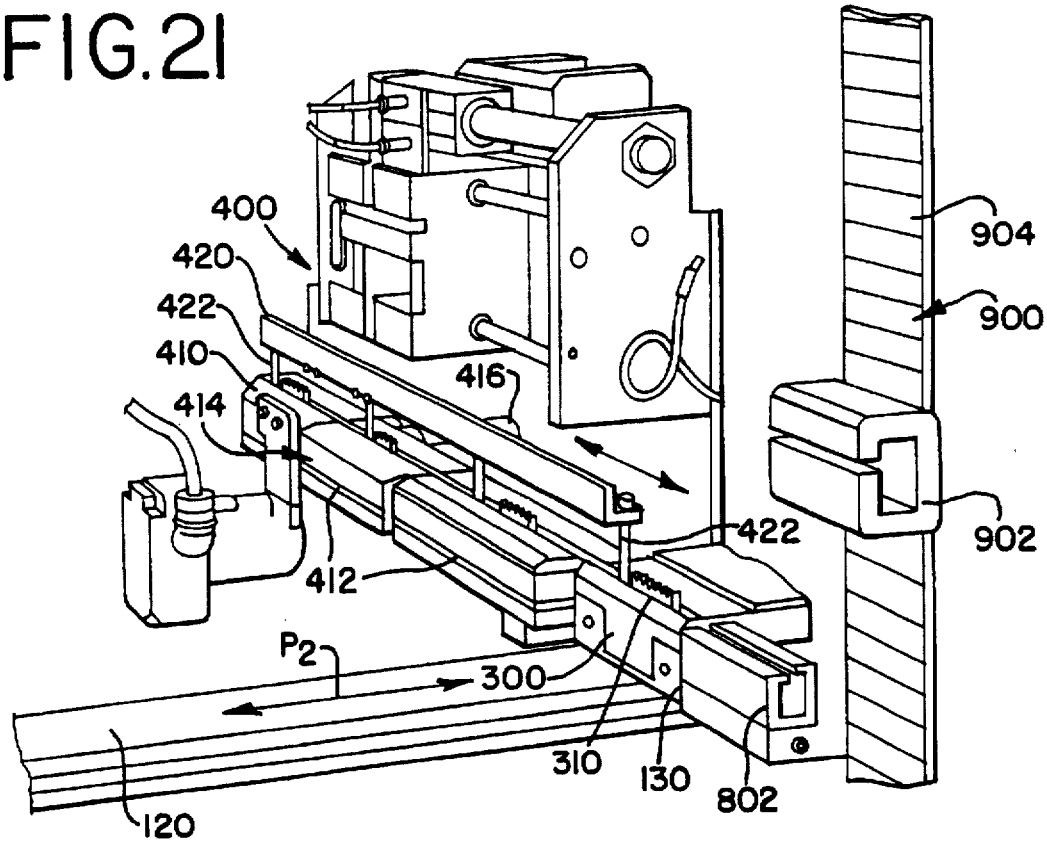
FIG. 21 is a perspective view of the lead connector element feed and harness ejection assemblies.

A feed assembly 400 is provided near the carriage nest assembly stop in order to successively feed individual leading connector elements, such as male connector elements 14 to the wire harness carriage assembly 300. As shown in FIGS. 1 & 21, the feed assembly 400 extends between a connector element supply 402 in the form of a bowl feeder 403 from which individual connector elements 14 are fed along an advancement track 404. The connector elements 14 pass by an array of sensors which detect the size and style of the connector element.

Should an incorrect connector element be detected, one of the sensors will send a signal to the apparatus controller informing it of the presence of the incorrect connector element and the apparatus will stop so that the connector element may be removed. An escapement block 406 is slidably mounted in line with the advancement track 404 and serves to isolate a single connector element from the supply as well as transfer it to an infeed track 410.

Once the connector element 14 is verified as a correct connector element, it is passed to the infeed track 410 that extends transverse to the wire harness feedpath $P_2$. The infeed track 410 is aligned with one or more guide tracks 412 in the form of aligned channel sections, one of which constitutes a connector element marking station 414. This marking station 414 includes a slot (not shown) in the wall of the guide track 412 over which is mounted an inkjet print head 416. As the connector elements 14 are moved through the guide track 412 and pass by the printing slot, the inkjet print head 416 sprays a connector element identification number onto the body portion 23 of the connector element 14.

In order to advance the connector elements successively to the carriage nest 310 and to eject completed wire harnesses from the carriage nest 310, the feed assembly 400 also forms part of a harness ejection assembly 800 in that includes an elongated, reciprocatable beam clamp 420 with a plurality of pusher pins 422 held therein a predetermined intervals. The beam clamp 420 is mounted above and in alignment with the guide tracks 412 so that the pusher pins 422 extend down to abuttingly contact the connector elements 14.

Modular Connector Element Feed Assembly

Figure 14:
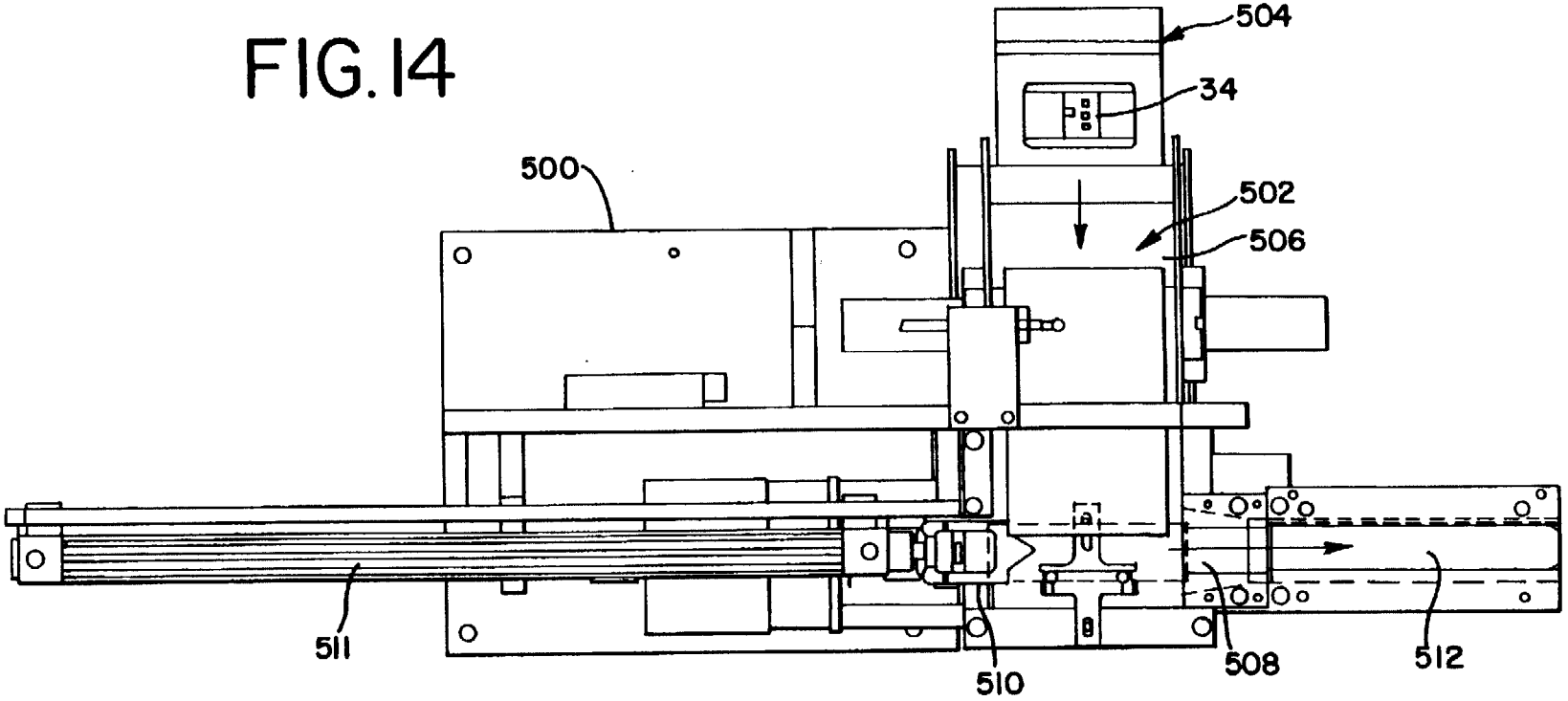
FIG. 14 is a top plan view of one of the modular connector element advancement means, illustrating the connector housing module advancement track.
Figure 15:
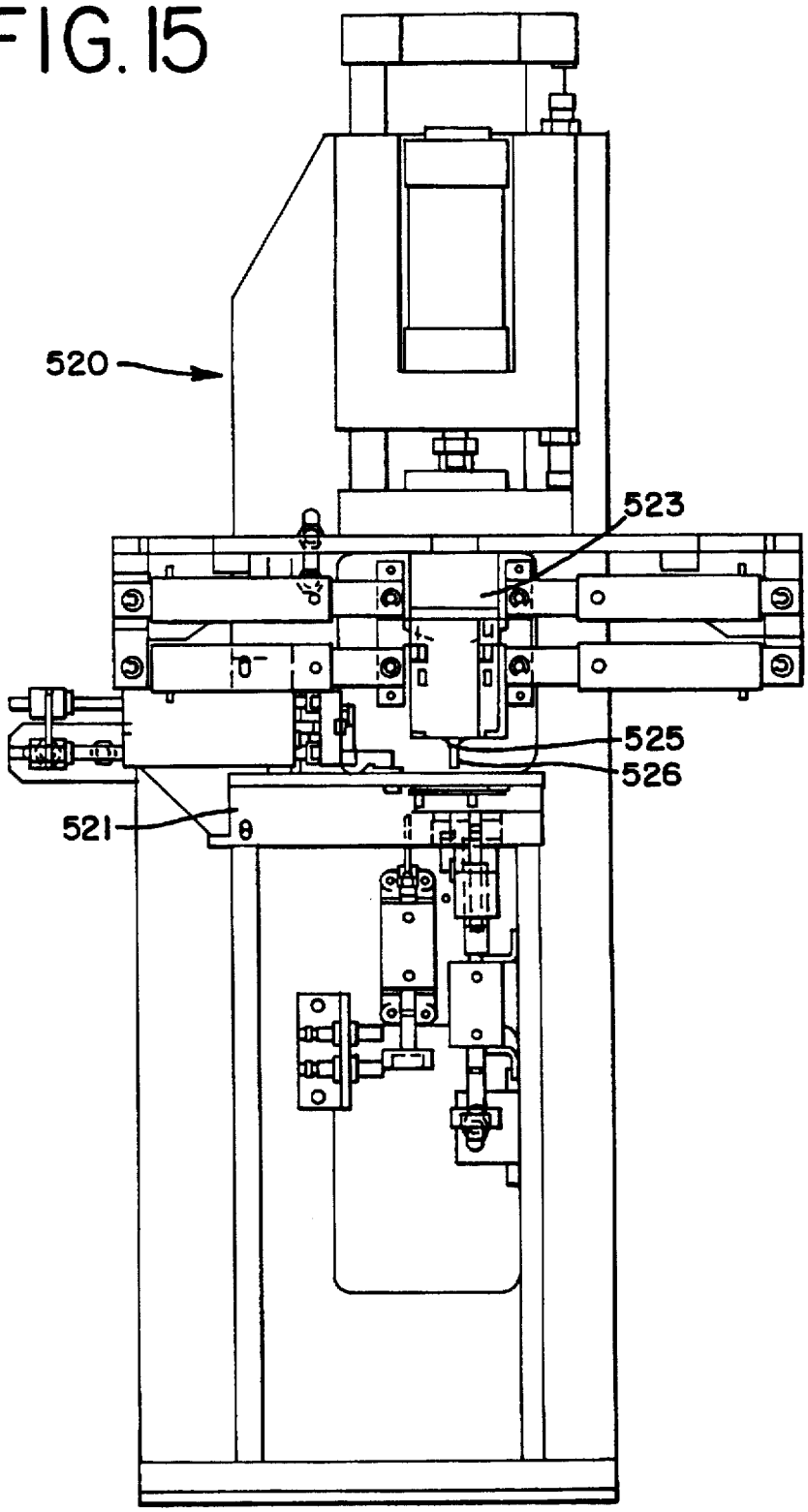
FIG. 15 is a side elevational view of the connector housing module programming station of the wire harness-making apparatus of FIG. 1.

Turning now to FIGS. 14 & 15, details of the feed assembly 500 for the modular connector elements are illustrated. Two supplies 502, 503 of connector modules are utilized with the apparatus 100 to supply the interengaging connector modules to the termination station. As shown in FIG. 6, one of the connector modules comprises a rectangular housing 34. These housings 34 are supplied from a supply area 502 by way of a plastic feed bandolier 504 in which the connector housing 34 are partially enveloped by plastic sheet film and are spaced apart from each other along the length of the feed bandolier.

The connector housing feed bandolier 504 is guided within a feed track 506 where the connector housing 34 is removed from the feed bandolier 504. As the connector housing 34 is removed it is urged into an entrance track 508 where it is contacted by a reciprocatable connector element advancement head 510 mounted on an air cylinder 511. The air cylinder 511 drives the advancement head 510 in the direction of the arrow shown in FIG. 14 and thereby drives the connector housing 34 out of the entrance track 508 and into an intermediate track 512.

The intermediate track 512 of the connector housing feed assembly 500 mates with a feed track 521 of a programming assembly 520 which is located adjacent to and downstream of the feed assembly 500. The programming assembly 520 includes a pneumatically operated die mechanism 523 having a programming punch 525 which includes multiple arms 526. Each of the arms 526 of the punch 525 are individually and selectively actuatable by associated cams (not shown) mounted within the body of the die mechanism 523. The punch arms 526 move down into opposition with the spring contact terminals 36*b* of the connector housing 34 and selected ones of the punch arms 526 move into further contact with the contact terminals 36*b* to bend them down into the central portion 37 of the connector housing 34 (FIG. 6) so that they will not contact the traces on the circuit board of the opposing connector module 29.

Once programmed, the connector housings 34 are moved further along their advancement track to a transfer head, or gantry 540. This transfer head 540 has a mechanical grip which reliably engages the programmed connector housing 34. A conventional robotic pick and plate mechanism may be used as the transfer head. The transfer head 540 reciprocates along a path transverse to the harness feed path $P_2$ and traverses the distance between the connector housing advancement track and the termination station 700. The transfer head 540 further places the connector housing module 34 in place on the wire bed 751 of the lower termination head 150 so that the connector housing module wire-receiving openings 41 oppose the grooves 752 forme in the wire bed 751. The transfer head still further holds the connector housing module 34 in place during termination of the harness wires 12 to it.

Figure 23:
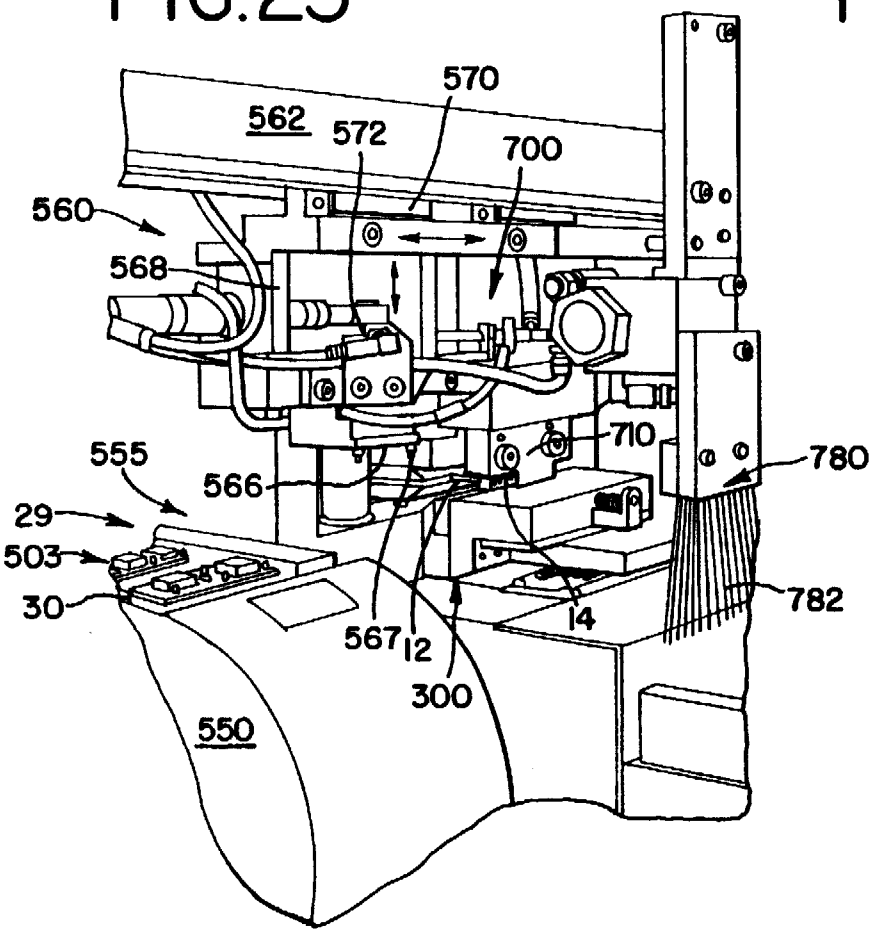

As best shown in FIGS. 1 & 23, the other connector module supply 503 is arranged in a direction parallel to the wire and harness feedpaths and includes a supply advancement means 550 which drives one or more supply bandoliers 551 of circuit board modules 29 to a presentation station 555, where the supply bandolier is removed and the circuit board modules 29 are presented for transfer to the termination station 700.

A circuit board module placement mechanism 560 is supported on the apparatus frame 562 and extends between the module supply presentation station 555 and the termination station 700. The placement mechanism 560 may take the form of a robotic pick and place assembly 564 which include a circuit board nest 566 having one or more vacuum cups 567 associated therewith which oppose and engage a surface of the circuit board modules 29. This circuit board nest 566 is movable in the vertical direction by way of guide rods 568 and also horizontally along a track assembly 570 formed on the frame. The distance which the placement mechanism may travel permits the arrangement of several module advancement means 550 in side-by-side order as shown in FIG. 1.

The circuit board nest 566 may also include a rotator cylinder 572 operatively connected thereto in order to rotate the circuit board modules 90° for proper alignment with and engagement into the connector housing 34.

Remaining Connector Element Feed Assembly

Figure 22:
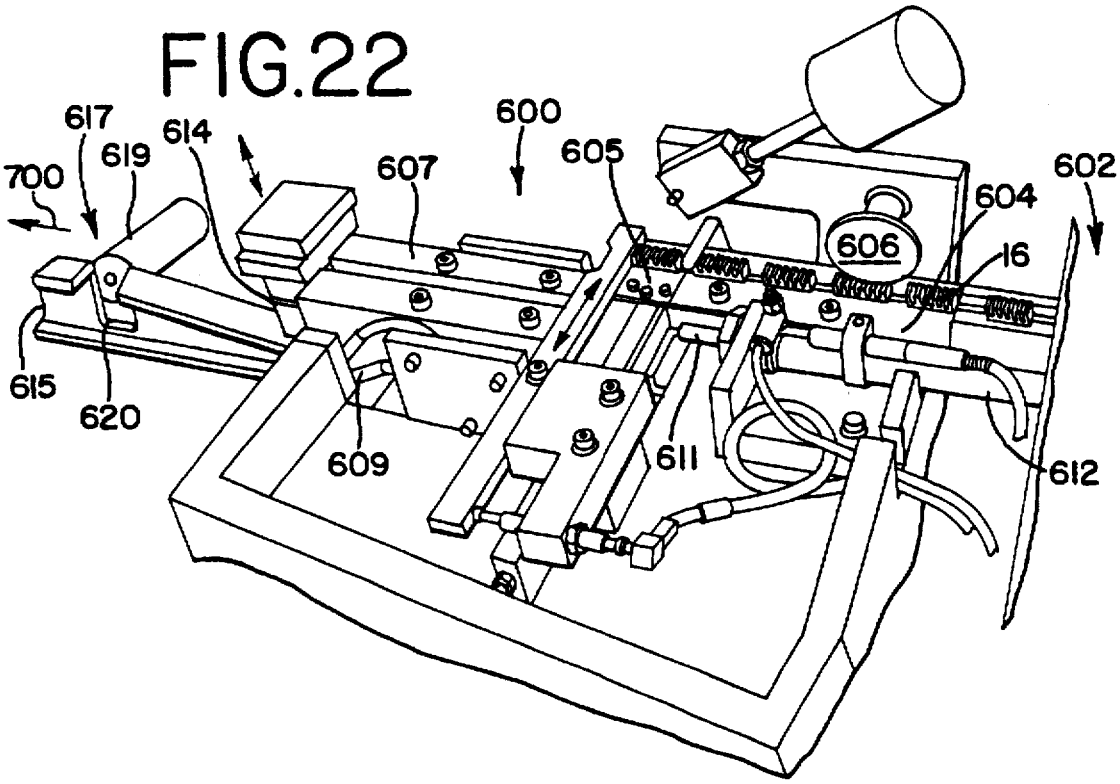
FIG. 22 is a perspective view of a subsequent connector feed assembly.

FIG. 22 illustrates an additional connector element feed assembly 600 which is commonly used in the apparatus 100 to feed additional, unitary connector elements other than the lead connector element to the termination station 700. For example, when producing wire harnesses of the type illustrated in FIG. 2, the lead connector of the harness 10 received in the carriage nest 310 is a male connector 14 and the female connector 16 shown third in line on the harness would be fed to the termination station by the additional connector element feed assembly 600.

The connector feed assembly 600 is operatively associated with a vibratory bowl feeder 602 which successively supplies male or female connector elements as needed to an infeed track 604 to a reciprocatable nest 605. The nest 605 may shuttle in a transverse direction. The connector elements 16 are advanced along the infeed track 604 by a motor operated advancement wheel 606 into the nest 605.

The nest 605 is thereupon actuated to transfer the connector element 16 to a position where it is aligned with a sensing track 607 which has an array of sensors 609, such as optical sensors that determine the size, shape and correctness of the connector element 16. The connector element 16 is then moved out of the nest 605 by a pushrod 611 connected to an air cylinder 612. At the exit 613 of the sensing track 607 is a connector elevator 614 which moves down in order to mate with a feed track 615 that extends to the termination station. The feed track 615 includes a marking station 617 having an inkjet print head 619 communicating with the feed track 615 through a slot 620 in the wall thereof. This print head 619 applies a unique identifying member to each of the male or female connector elements on the body portions 17 thereof.

Termination Assembly

Turning now to FIGS. 16–20, a termination station 700 is provided in the apparatus which is capable of terminating the different styles of connector elements used on wire harnesses 10 produced by the present invention. The male and female connector elements 14, 16 may be considered as one style while the input-output connector elements 15 may be considered as another style. The male and female connector elements 14, 16 may be referred to their common name in the art, i.e., "mini-fit" connectors. The two connector element styles differ not only in body construction, i.e., unitary or one-piece construction vs two-piece construction, but also in the placement of their respective wire-receiving openings. These openings 18 of the male and female connector elements 14, 16 illustrated in FIGS. 2–5 open along the top surfaces thereof, while the wire-receiving openings, or channels 41 of the input-output connector elements 15 open along the bottom surface thereof. This difference in connector structure dictates the use of a multi-component termination assembly.

Figure 16:
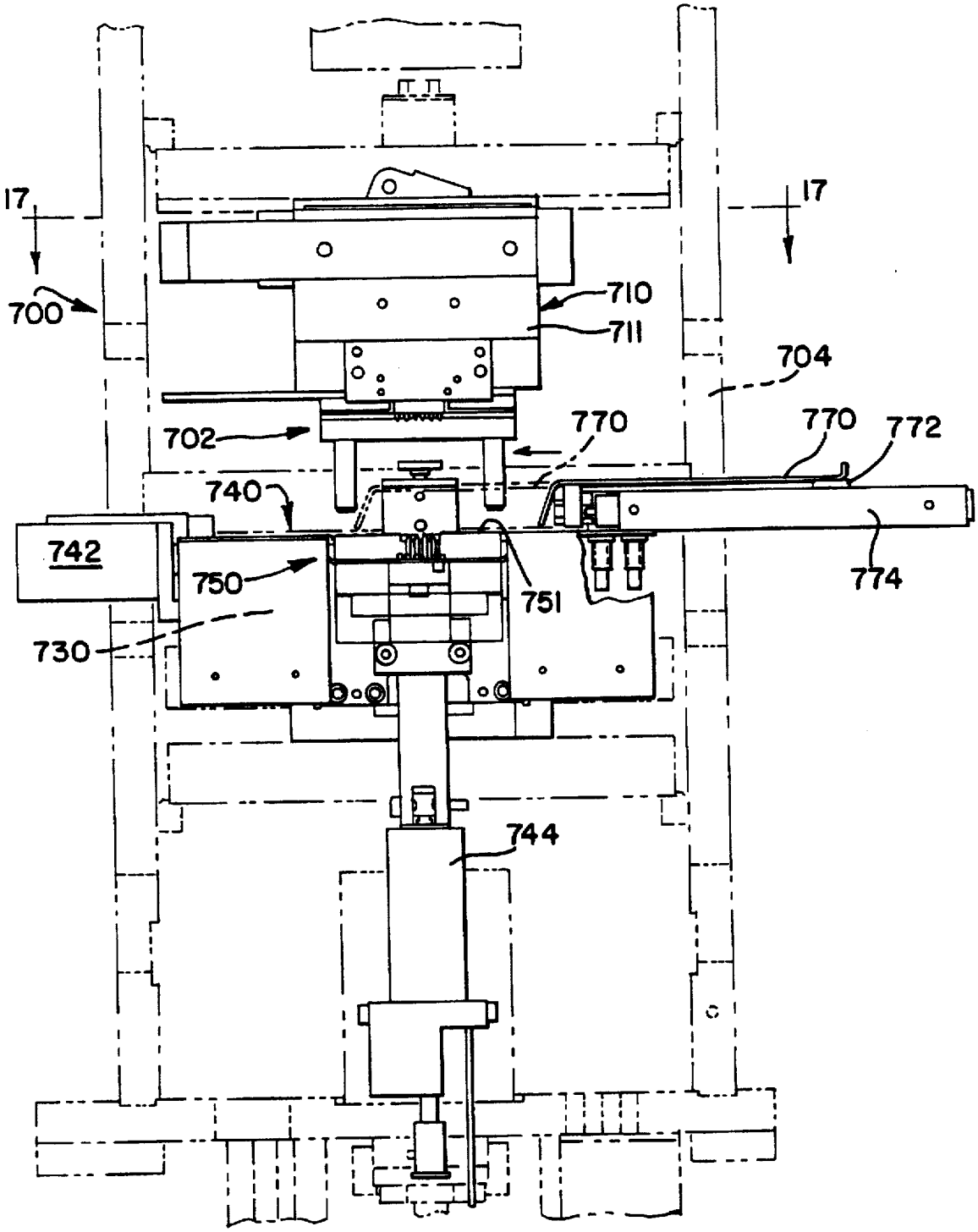
FIG. 16 is a front elevational view of the termination station of the wire harness-making apparatus of FIG. 1.
Figure 17:
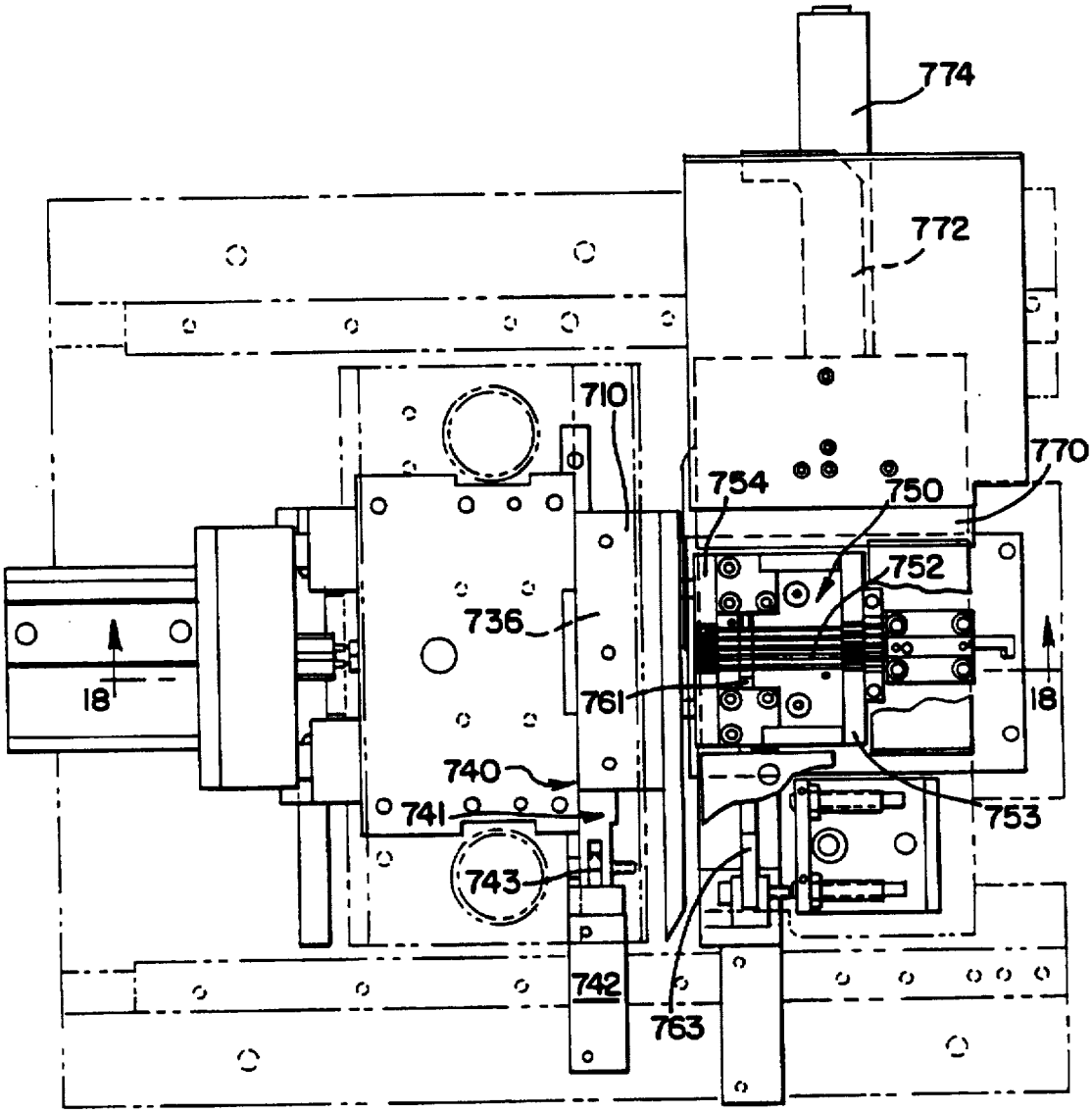
FIG. 17 is a top plan view of the termination station of the wire harness-making apparatus of FIG. 1 taken generally along line 17—17 of FIG. 16.

FIG. 16 is an elevational view of the termination station 700 and depicts the termination assembly 702 disposed within a frame 704. The termination assembly 702 includes a termination die and a moveable wire clamp 706 (FIG. 18) which reciprocate vertically within the frame 704. The termination assembly 702 may be considered as having three distinct interacting termination heads 710, 730 and 750. The first termination head 710 may be considered as an upper termination head because it is positioned above the level H of the harness wires 12 as they exit the wire clamp 706. This termination head 710 is driven by a termination die press 711 in a vertical stroke within the termination assembly 702. This termination head 710 is driven downwardly toward and into contact with the leading connector element **14*a* held in the carriage nest 310 at the beginning of a wire harness assembly cycle. This downward stroke of the termination head 710 is depicted in FIG. 23, where the carriage assembly 300 has been brought into the termination station 700**.

Figure 20A:
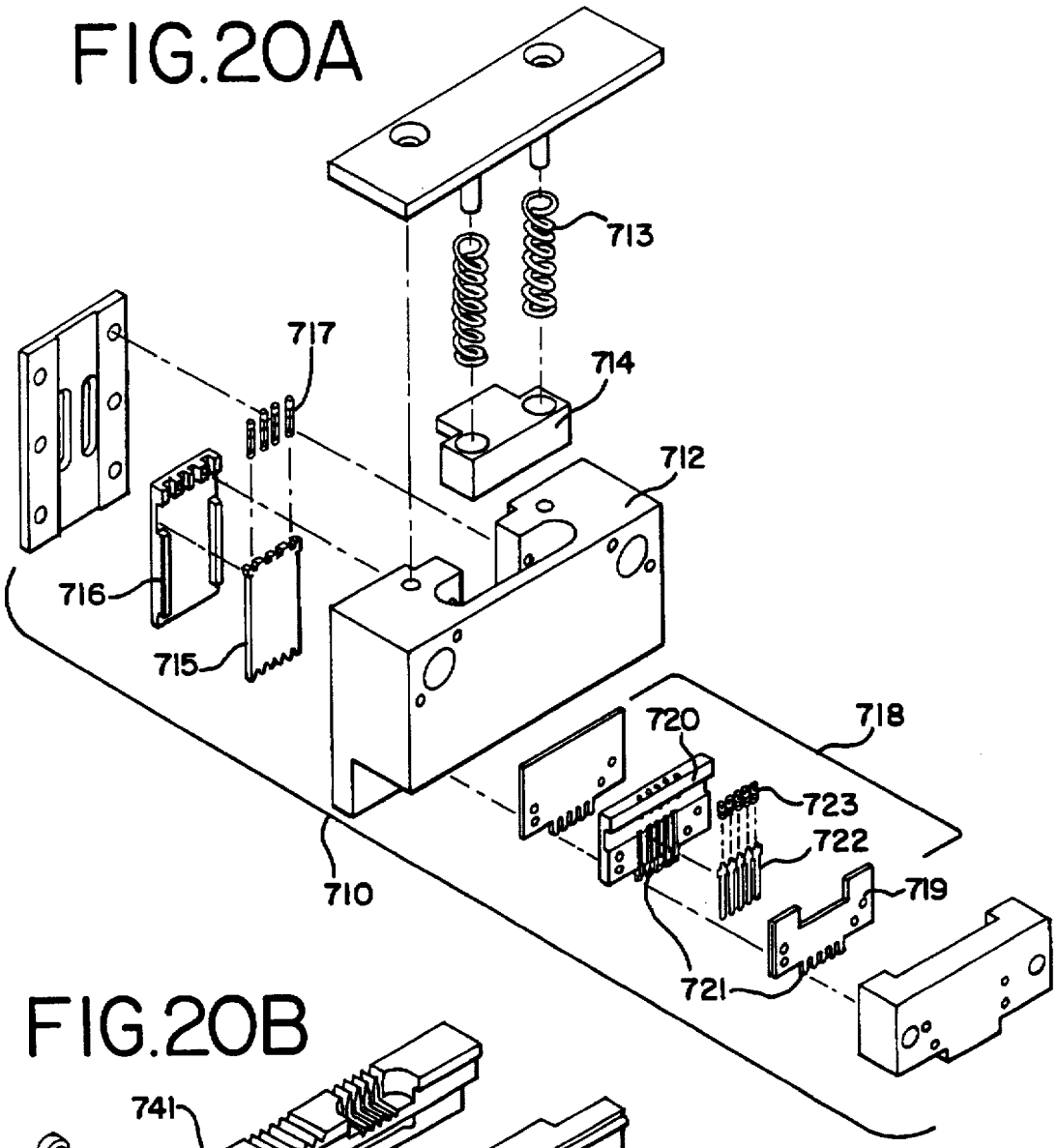
FIG. 20A is an exploded perspective view of the upper termination block of the termination station.

The termination head 710, as best shown in FIG. 20A, includes a termination blade holder 712 which encloses a pair of compression springs 713 supported in a spring holder block 714. A wire locator 715 engages a rear termination blade 716 by way of springs 717. This wire locator 715 ensures that the harness wires 12 are oriented in alignment with the wire-receiving openings 18 of the mini-fit male or female connector held in the carriage nest 310. The termination head 710 further includes a termination blade mechanism 718 at its forward (or downstream) face. The termination blade 718 mechanism includes a pair of cooperating termination blade members, or punches 719, 720 having a plurality of projecting ends 721 that are adapted to contact the harness wires 12 aligned by the wire locator 715 and opposing the connector element wire-receiving openings 18.

These two termination blade members 719, 720 enclose a plurality of electrically conductive continuity test probes 722 which are biased by associated compression springs 723 so that they will contact the insulation displacement terminals of the connector elements 14, 16 and move upwardly in the termination blade mechanism 718 driving termination. As mentioned previously, these test probes 722 are connected to sensors so that when a potential is applied by the carriage nest test probes 329 to the internal contacts of the leading connector element the potential may be read by the termination head test probes 722 at the insulation displacement terminals of the leading connector element, thus testing the leading connector element (and any subsequent unitary style male or female connectors intended for termination to the wire harness) for electrical integrity.

A second termination head 730 is disposed in the termination assembly 702 generally below the first termination head 710. This termination head 730 includes a nest 732 formed by two cooperating blocks 733, 734 which receive an additional connector element from its associated connector element feed assembly 600 and in particular, the feed track 615 thereof. This track 615 and the connector element termination nest 732 extend transversely to the axes of the harness wires 12 extending through the termination station 700. The nest 732 is mounted adjacent an inner wire comb 735 which is mounted on a reciprocating cylinder 736. This comb 735 may be selectively actuated to hold the harness wires 12 during termination.

Figure 18:
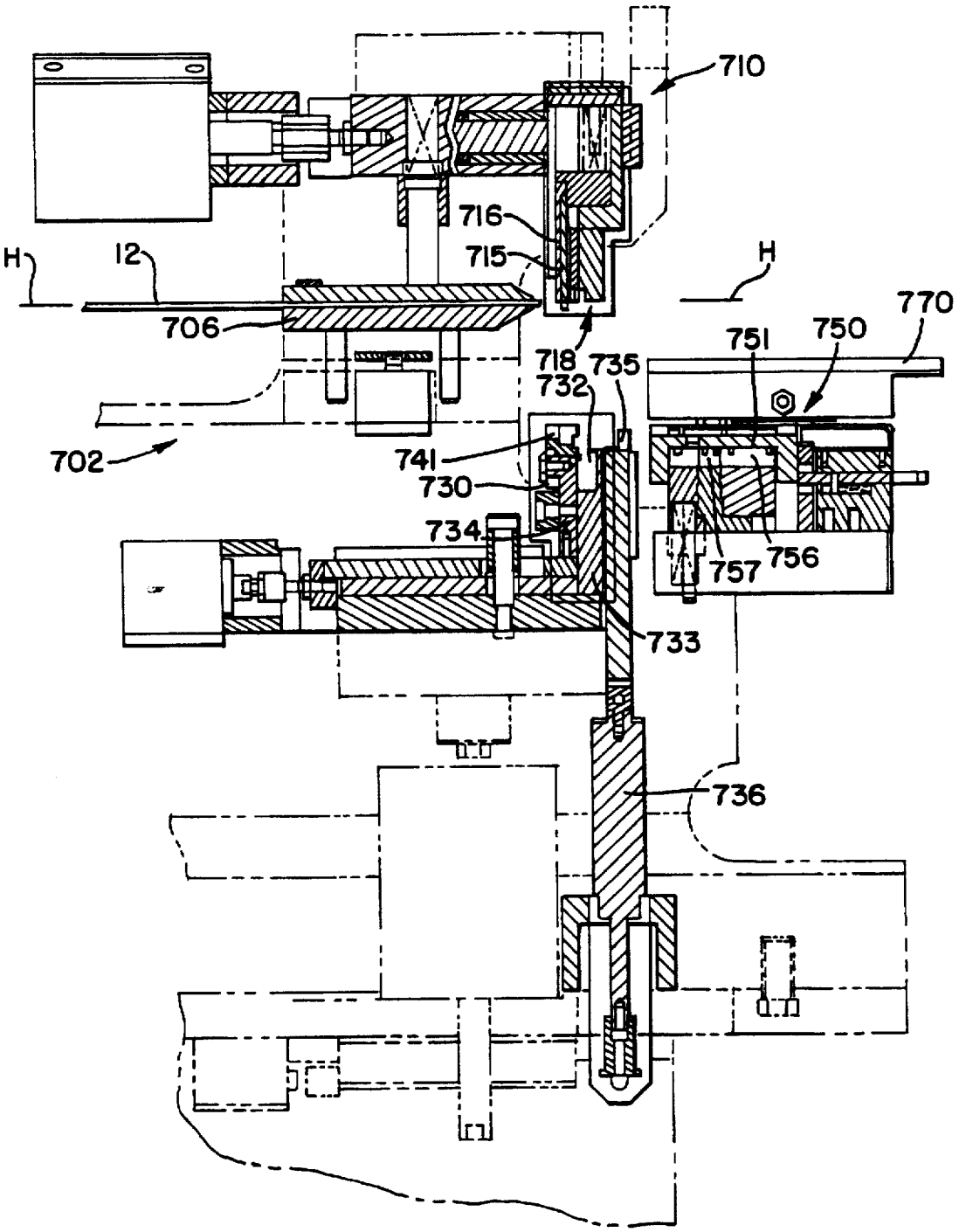
FIG. 18 is a cross-sectional view of the termination station taken generally along line 18—18 of FIG. 17.
Figure 20B:
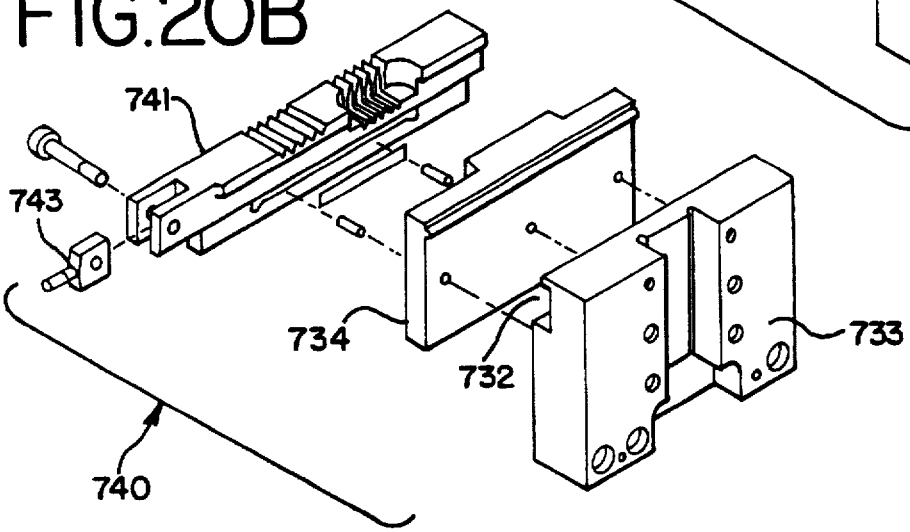
FIG. 20B is an exploded perspective view of the knife assembly utilized in the termination station.

As best illustrated in FIG. 20B and as generally shown in FIG. 18, the second termination head 730 includes a knife assembly 740 which is positioned adjacent and upstream of the connector element termination nest 732. The knife assembly 740 includes a cutoff bar 741 reciprocatably mounted to a power cylinder 742 by way of a clevis 743.

Figure 19:
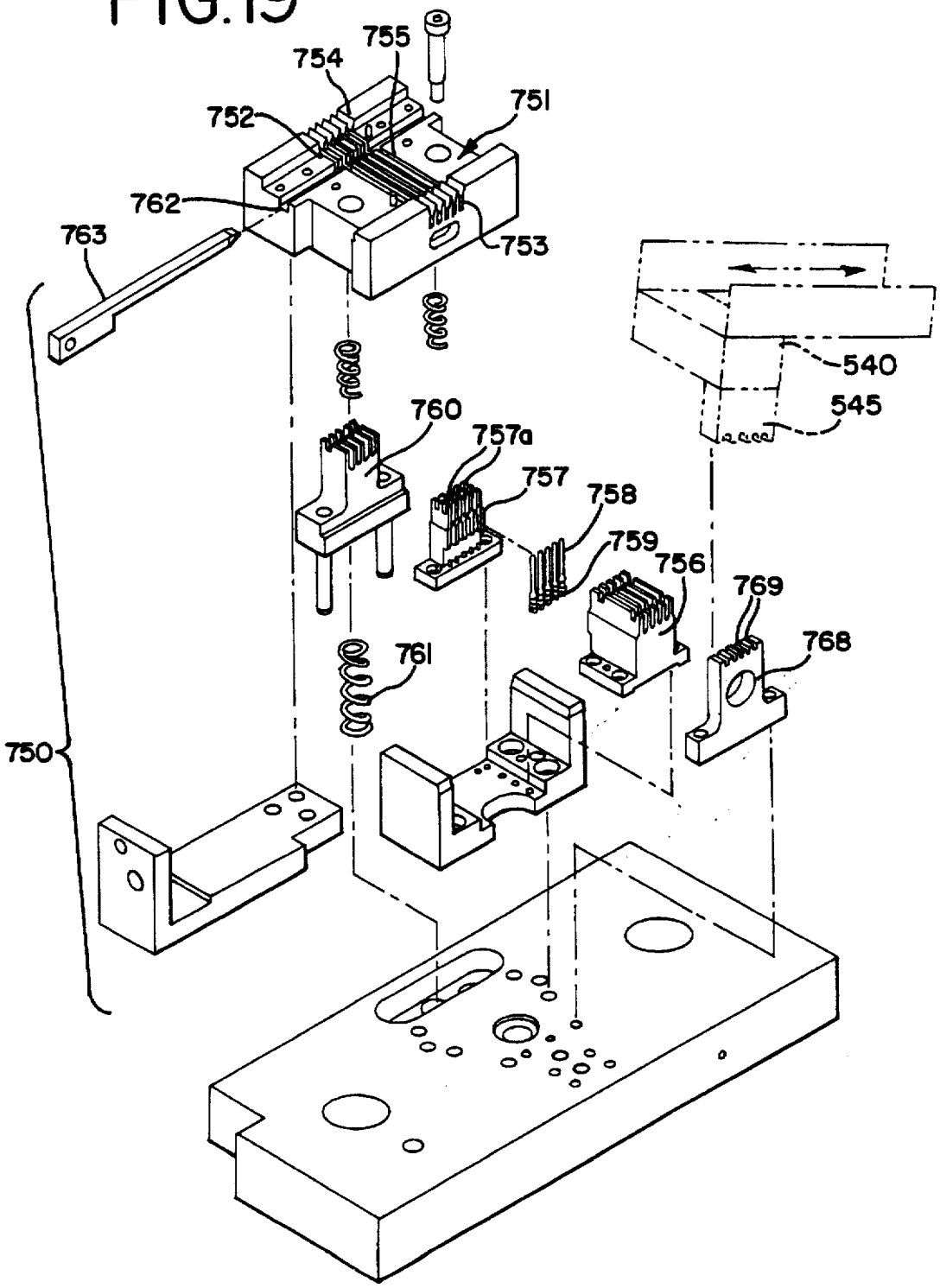
FIG. 19 is an exploded perspective view of the modular connector lower termination block of the termination station.

The termination assembly 702 includes a third termination head 750, best illustrated in FIG. 19, which provides a means to terminate the two-piece input-output connector elements 15. This termination head 750 is located downstream of the other two heads 710, 730. A wire bed 751 is provided and has a plurality of grooves 752 formed thereon. The wire bed 751 includes fore and aft comb portions 753, 754 which guide the harness wires 12 as they are advanced through the wire clamp 706.

Because the input-output connector elements 15 have their wire-receiving openings, or channels 41 on their underside, portions of the grooves 752 include open slots 755. These slots 755 permit the passage therethrough of three termination blades, or punches 756, 757 & 760 which are adapted to engage and press against the undersides of the harness wires 12. One of the punches 757 has a series of vertical grooves and a plurality of mounting posts which retain in place a series of continuity test probes 758. The test probes 758 are mounted upon springs 759 and held between the two termination blades 757 & 759 so that they may deflect downwardly during termination yet still maintain contact with the insulation displacement terminals 39 of the input-output connector elements 15.

These probes 758 are connected to a testing device so that the potential applied to the leading connector element contacts by the carriage nest test probes 329 may be analyzed during termination. A high potential across any one of the testing circuits will indicate to the apparatus operator the presence of either a defective connector element terminal or a break in the associated harness wire of that circuit.

Upstream and adjacent the input-output connector termination of cutoff blade 757 and termination punch 756, an additional input-output connector termination blade 760 is provided which is biased by an associated spring 761. This wire retainer 760 extends vertically above the wire bed assembly during times when the wire bed assembly 751 is drawn down, such as when the connector housing module 34 is brought down against the wire bed 751 by its transfer head 540. The wire bed assembly 751 may further include a transverse slot 762 which receives a reciprocatable wire contact blade 763 which assists in severing the harness wires 12 when an input-output connector element is the last connector element terminated to a wire harness. The severing of the wires is accomplished by moving the wire contact blade 763 into the wire bed slot 762 over the wires. The underside 764 of the wire contact blade 763 presents a hard surface against which the rear projections **757*a* are pressed against when the wire bed 751 is pressed down by the vertical placement movement of the connector housing module transfer head 540. In order to preserve the order and spacing of the harness wires during termination of the lower connector housing 34 to the harness wires, a stationary lower wire clamp 768 rises into contact with the wires 12 as the wire bed 751 is pressed down. Channels 769 formed in the top of this wire clamp 768 catch the wires. The wire clamp 768 mates with a complementary wire clamp 545 positioned in the front of the transfer head 540. This wire clamp 545 is spring biased so it may collapse against the termination head wire clamp 768**.

Figures 25, 26, 27:
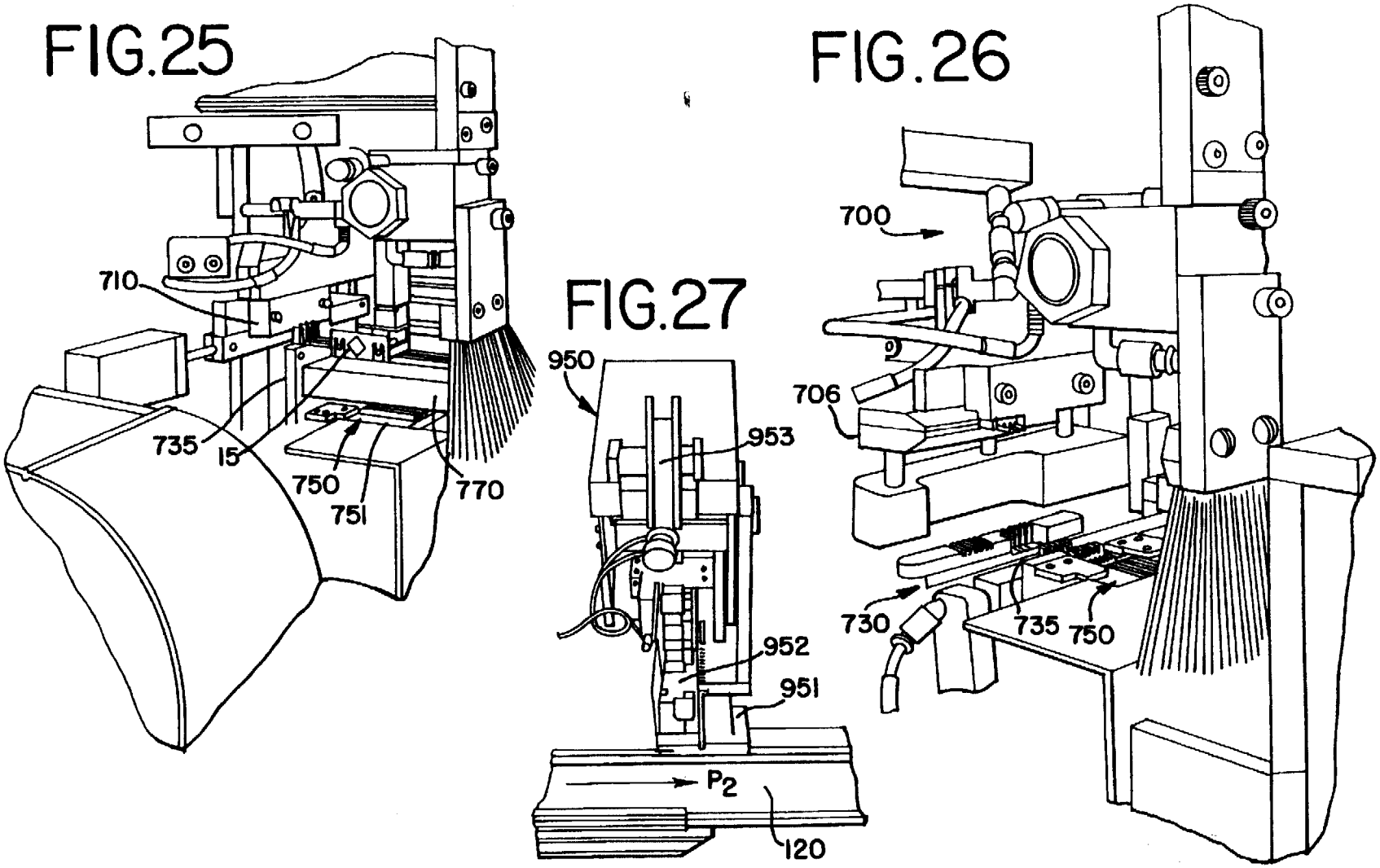
FIG. 27 is an elevational view of a taping assembly positioned along the wire harness feedpath of the wire harness-making apparatus of FIG. 1.

The grooves 752 of the wire bed 751 and its associated wire termination blades 756, 757 and 760 present a series of sharp edges which might catch on the last connector element terminated to the harness wires after its wires are cut and it drops from the wire level to the wire harness collection trough 120. In order to prevent this problem, the present invention provides a slidable shelf member 770 which is mounted on a support rail 772. The shelf member 770 is driven by a pneumatic cylinder 774, as illustrated in FIG. 25, and is laterally extendable over the termination head 750 to cover the wire bed 751 and retracts as soon as the trailing connector element clears the termination assembly 702.

Turning to FIGS. 23–26, some of the steps of termination are illsutrated. In FIG. 23, the carriage assembly 300 has been moved into the termination station 200 and the connector element 14 held thereby is aligned with the upper termination head 710. Contact between the termination head 710 and the connector element 14 results in termination of the wires 12 to the connector element insulation displacement terminals after which the carriage assembly 300 is moved downstream along the harness feedpath $P_2$, passing through a wiping station 780 having a brush 782 interposed in the path of the carriage assembly 300.

Figure 24:
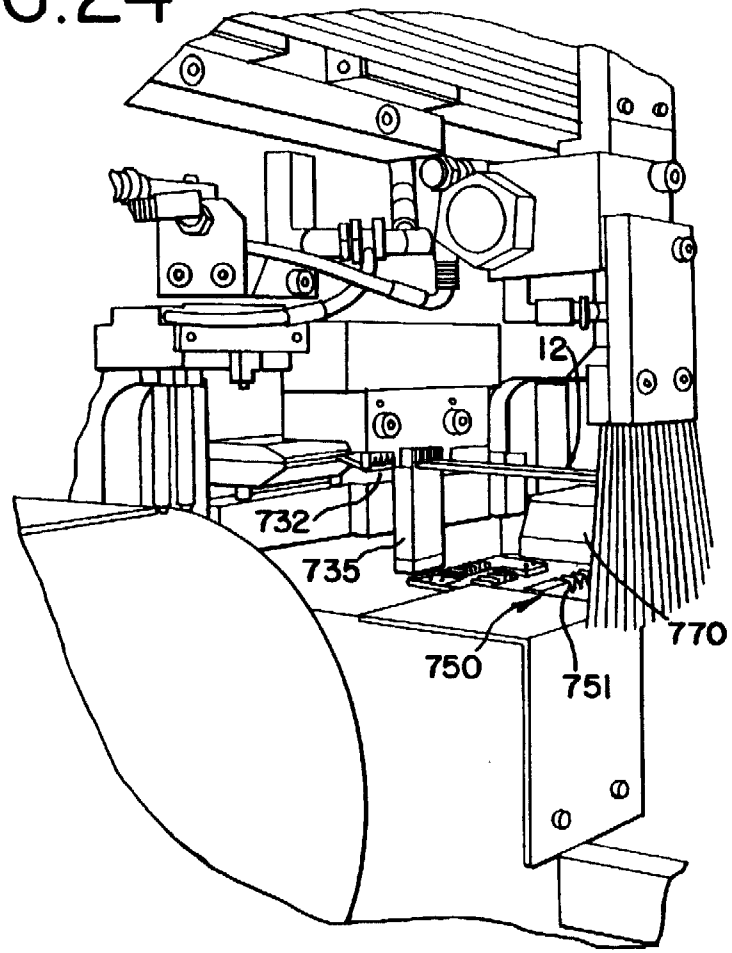
FIGS. 23–26 are detailed perspective views of the termination station at various steps of operation of the apparatus illustrating the interaction of the termination assembly components and in particular

In FIG. 24, a male or female connector element has been advanced into the termination nest 732 by its feed assembly 600 by way of the feed track 615 (FIG. 22) and brought into contact with the harness wires 12 and the termination head 710 to effect termination thereof. During this action, the wire comb 735 is also extended into contact with the wires 12. The comb 735 also holds the wires in place when the ends are cut, such as is illustrated in FIG. 25. FIG. 25 illustrates the cutting of the harness wires after termination of a modular connector element 25. In this cutting stroke, the shelf member 770 as synchronized to extend over the wire bed 751 and underneath the last terminated connector element. FIG. 26 illustrates the wires in a ready position after they have been cut and after retraction of the lower termination head 730.

Wire Harness Ejection Assembly

Once a wire harness is completed by terminating its trailing connector and cutting the harness wires, the carriage assembly 300 moves downstream into the opening 130 formed between the leading connector element feed assembly 400 and a harness collection assembly 900. This area contains, in effect an ejection station 800 of the apparatus 100. In this position, the carriage assembly 300 rests against the carriage stop 340 and the carriage nest 310 is aligned with the two connector element tracks. The beam clamp 420 is thereupon actuated and the lead pusher pin 422 impinges against the leading connector element **14*a* and pushes it out of the carriage nest 310 through an adjoining receiving track 802 and further into the a transfer channel 902 mounted on a flexible, movable belt 904 where it is conveyed to a storage rack 906**.

Harness Wire Taping and Marking Assemblies

Two harness wire taping means 950 and 975 are provided in the present invention. The first of these taping means 950 is a conventional wire taper, such as one manufactured by Gettig and, as illustrated in FIG. 27, is mounted on a pedestal 951 adjacent to the wire harness feedpath and the over the wire harness collection trough 120. The taper has a conventional jaw 952 for engaging the harness wires 12 and a supply of adhesive tape 953 which is applied around the harness wires when received within the taper jaw to apply o tape length 955 thereto. The taper 950 is movable along the trough 120 and motorized so that multiple tape lengths may be applied to the harness wires at different, predetermined locations as shown in FIG. 8I.

A second taping means 975 is located alongside the trough 120 (FIG. 1) and contains a supply of adhesive tape and a printing means, such as a dot-matrix printer so that each wire harness made on the apparatus may be identified or labeled with a harness code number on a label 977 applied near the leading connector element **14*a* of the wire harness 10. (FIG. 8K**.)

The operation of the apparatus may be controlled by a PLC programmable logic controller 1000 which displays the operating state of the apparatus 100 on a display screen 1002. The various sensors of the apparatus, i.e., the housing detectors, missing and wire splice detectors and continuity test probes are interconnected to the PLC so that all sequences of operation of the apparatus 100 may be constantly monitored. Any signal that is received by the PLC which indicates a defective connector element or wire will trigger an alarm to alert the operator of the defeat and stop operation of the apparatus to prevent the manufacture of defective harnesses.

The apparatus of the present invention is capable of producing wire harnesses having lengths of between 6 inches and 120 inches with any desired number and arrangement of different style connector elements. The connector elements may be uniquely identified with numerical codes or other identifying indicia, which code correlates to a corresponding opposing connector in the machine in which the final harness is used. It will therefore be appreciated that the present invention automates the production of wire harnesses to an extent heretofore unknown in the art.

It will be appreciated that the embodiments of the present invention which have been discussed are merely illustrative of some of the applications of this invention and that numerous modifications may be made by those skilled in the art without departing from the true spirit and scope of this invention.

We claim:

1. An apparatus for assembling wire harnesses in which each assembled wire harness has a plurality of elongated wires with first and second connector elements being interconnected to said harness wires at locations spaced apart from each other at predetermined spacings, the second connector elements being of modular construction and having first and second modules which interengage with each other to form a second connector element, said second connector elements further having a plurality of programmable contact terminals, the apparatus comprising:

a supply of harness wires;

means defining a wire feedpath between the wire supply and a first work station;

wire feed means for feeding multiple wires along the wire feedpath from said wire supply to the first work station;

a supply of first connector elements and means for successively advancing individual first connector elements in serial order from said first connector element supply;

carriage means for moving between said first connector element advancement means and said first work station, the carriage means including a connector element nest for receiving a first connector element therein from said first connector element advancement means;

said first work station including a termination assembly aligned with said wire feed means, the termination assembly having first termination means for terminating first ends of said wires fed from said wire supply to a first connector element advanced from said first connector element supply;

respective supplies of the second connector element first and second modules, and means for successively advancing individual second connector element first and second modules from said respective supplies to said first work station;

a second work station interposed between said second connector element first module supply and said first work station, the second work station including programming means for programming said contact terminals of said second connector element first modules;

means for assembling said second connector element first and second modules together at said first work station;

second termination means for terminating said second connector elements to said wires; and wire cutting means disposed in said first work station for cutting said wires to define a tail end of said wire harness wires.

2. The wire harness assembly apparatus of claim 1, further including wire taping means for taping said harness wires together between connector elements terminated thereto, the wire taping means being disposed downstream of said first work station.

3. The wire harness assembly apparatus of claim 1, wherein said second connector element first modules include connector housings having support surfaces disposed therein and said second connector element second modules include printed circuit boards which are received on said connector housing support surfaces.

4. The wire harness assembly apparatus of claim 3, wherein said second connector element first and second module advancement means includes means for transferring a circuit board from said second connector element second module supply to said first work station and applying it onto said second connector element connector housing support surface.

5. The wire apparatus of claim 1, further including connector detection means for detecting the style of said first connector elements prior to advancing said first connector element to said first work station.

6. The wire apparatus of claim 1, including continuity testing means for testing the continuity the wire harnesses during each termination of connector elements to said wires, the continuity testing means including a plurality of first electrical probes disposed within said carriage means which are moveable into electrical engagement with contact terminals of said first connector element received in said carriage assembly and a plurality of second electrical probes disposed operatively associated with said termination assembly and moveable into electrical engagement with contact terminals of said second connector elements during termination thereof to said wires.

7. The wire apparatus of claim 1, further including connector element marking means for applying an identifying indicia to at least one of said first and second connector elements prior to termination thereof to said harness wires.

8. The wire apparatus of claim 1, wherein said carriage means is reciprocatable along said wire harness feedpath downstream of said first work station and said wire feedpath and wire harness feedpath are substantially aligned.

9. The wire apparatus of claim 8, further including a wire harness ejection assembly, the ejection assembly including a transfer channel member disposed transverse to said wire harness feedpath at a predetermined harness end location on said wire harness feedpath, in alignment with said first connector element advancement means to define an opening therebetween that receives said carriage means in alignment therewith.

10. The wire harness assembly apparatus of claim 1, further including a connector element support shelf operatively associated with said first work station, the support shelf being reciprocatable into and out of said termination assembly when said harness wires are severed to thereof support the last connector element terminated to said harness wires.

11. A wire harness assembly machine for assembling wire harnesses by terminating a plurality of connectors to the wires of the wire harness, at least one of the connectors including a modular connector having interengaging first and second connector modules, the machine comprising:

a supply of wires;

a termination assembly for terminating said connectors to said wires;

a connector nest holding a lead connector in place within said termination assembly while said wires are terminated to said lead connector, the connector nest being mounted on a reciprocatable carriage for moving said connector nest into and out of said termination assembly;

a supply of first and second connector modules;

first connector module feed means for feeding successive first connector modules to said termination assembly for termination to said wires;

second connector module feed means for feeding successive second connector modules to said termination assembly and into engagement with said first connector modules; and marking means for marking said connectors with an identifying indicia as they are advanced to said termination assembly.

12. The machine of claim 11, further including harness continuity testing means, the harness continuity testing means including first electrical contact means operatively associated with said connector nest and second electrical contact means operatively associated with said termination assembly.

13. The machine of claim 11, further including a supply of additional connectors and additional connector feed means for feeding successive additional connectors to said termination assembly for termination to said wires.

14. The machine of claim 11, wherein said termination assembly includes a first termination member for terminating said wires to said lead connector and a second termination member for terminating said wires to first connector module, said first and second termination members being independently actuatable of each other.

15. The machine of claim 12, wherein said termination assembly includes a first termination member for terminating said wires to said lead connector and a second termination member for terminating said wires to first connector module, said first and second termination members being independently actuatable of each other, and wherein said second electrical contact means includes first electrical probes operatively associated with said first termination member and second electrical probes operatively associated and said second termination member.

16. The machine of claim 11, wherein said first connector modules include a plurality of programmable contact terminals and said machine further includes means for programming said first connector module programmable contacts.

17. The machine of claim 11, wherein said first and second connector module feed means are disposed on opposite sides of said termination assembly and feed their respective first and second connector modules to said termination assembly along paths generally transverse to longitudinal axes of said wires.

18. The machine of claim 16, wherein said first connector module programming means includes means for selecting and verifying said programming of said first connector module programming contacts.

19. An apparatus for assembling wire harnesses in which each wire harness has multiple wires and a plurality of connector elements terminated to the multiple wires at predetermined locations along the length of said wire harness, the connector elements being separated from each other by intervening lengths of said multiple wires, the apparatus comprising:

a wire supply; means for feeding multiple wires from said wire supply along a wire feedpath; a termination assembly interposed in said wire feedpath for terminating individual connector elements to said multiple wires at said predetermined locations; a supply of leading connector elements; a carriage for receiving a leading connector element and moving the leading connector element toward the termination assembly for termination to leading ends of said multiple wires and further for moving said leading connector element away from said termination assembly to feed out preselected lengths of said multiple wires from said termination assembly; a supply of subsequent connector elements for termination to said multiple wires at preselected locations on said multiple wires corresponding to said preselected lengths; and, wire harness continuity testing means including first test probes disposed in said carriage in electrical engagement with said leading connector element and second test probes disposed in said termination assembly which are brought into electrical engagement with said subsequent connector elements during the termination thereof, whereby the continuity of said multiple wires and said leading and subsequent connector elements may be tested at each termination thereof to said multiple wires.

* * * * *